US009172163B2

(12) United States Patent
Zantout et al.

(10) Patent No.: US 9,172,163 B2
(45) Date of Patent: Oct. 27, 2015

(54) ELECTRICAL CONNECTORS FOR USE WITH PRINTED CIRCUIT BOARDS

(71) Applicant: IDEAL INDUSTRIES, INC., Sycamore, IL (US)

(72) Inventors: Alan E. Zantout, Sycamore, IL (US); Dennis M. Breen, IV, West Chicago, IL (US); Benjamin D. Swedberg, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 138 days.

(21) Appl. No.: 13/922,890

(22) Filed: Jun. 20, 2013

(65) Prior Publication Data

US 2014/0154892 A1 Jun. 5, 2014

Related U.S. Application Data

(60) Provisional application No. 61/662,676, filed on Jun. 21, 2012, provisional application No. 61/831,340, filed on Jun. 5, 2013.

(51) Int. Cl.

| | |
|---|---|
| ***H01R 12/00*** | (2006.01) |
| ***H01R 12/71*** | (2011.01) |
| ***H01R 12/73*** | (2011.01) |
| ***H01R 12/89*** | (2011.01) |
| *H01R 12/70* | (2011.01) |
| *H01R 12/75* | (2011.01) |
| *H01R 31/08* | (2006.01) |

(52) U.S. Cl.

CPC ..... *H01R 12/716* (2013.01); *H01R 12/732* (2013.01); *H01R 12/89* (2013.01); *H01R 12/7088* (2013.01); *H01R 12/75* (2013.01); *H01R 31/08* (2013.01)

(58) Field of Classification Search

USPC ..... 439/65, 67, 79, 492, 495, 660, 496, 70, 439/76.1, 948, 377

See application file for complete search history.

(56) References Cited

U.S. PATENT DOCUMENTS

| | | | | | |
|---|---|---|---|---|---|
| 5,647,749 | A | * | 7/1997 | Atoh et al. | 439/79 |
| 5,688,130 | A | * | 11/1997 | Huang | 439/79 |
| 5,816,861 | A | * | 10/1998 | Cheng | 439/653 |
| 6,338,631 | B1 | * | 1/2002 | Hashimoto et al. | 439/79 |

(Continued)

FOREIGN PATENT DOCUMENTS

EP 2209165 A1 7/2010

OTHER PUBLICATIONS

ISA/US, International Search Report and Written Opinion issued on PCT Application No. US2013/046812, received Dec. 5, 2013, 15 pages.

*Primary Examiner* — Jean F Duverne

(74) *Attorney, Agent, or Firm* — Greenberg Traurig, LLP

(57) ABSTRACT

A connector for electrically connecting a conductor to a first printed circuit board (PCB) or for electrically connecting a first and second PCB together. A housing is adapted to be slidably moveable relative to a mounting structure to allow the mounting of the PCB to the surface and moveable over the PCB to contact pads located on the top side of the PCB. In another example, a bridging connector for electrically connecting a first PCB with a second PCB includes a resilient holding element, such as for example a spring clip, engageable with at least one of the PCBs and/or a surface supporting the PCB(s) to releasably retain the housing and the terminals in the correct location.

40 Claims, 33 Drawing Sheets

(56) References Cited

U.S. PATENT DOCUMENTS

| | | | | |
|---|---|---|---|---|
| 6,817,868 | B2 * | 11/2004 | Matsuo et al. | 439/65 |
| 7,261,569 | B2 * | 8/2007 | Uchida et al. | 439/67 |
| 7,462,036 | B2 | 12/2008 | Shin et al. | |
| 7,892,022 | B2 | 2/2011 | Mostoller et al. | |
| 8,025,507 | B2 | 9/2011 | Kim et al. | |
| 2010/0142204 | A1 | 6/2010 | Bishop | |
| 2010/0142205 | A1 | 6/2010 | Bishop | |
| 2011/0207372 | A1 | 8/2011 | Breen, IV | |

* cited by examiner

Sliding Feature Allows for Vertical PCB Installation/Replacement

ELECTRICAL CONNECTORS FOR USE WITH PRINTED CIRCUIT BOARDS

CROSS REFERENCE TO RELATED APPLICATION

This application is a non-provisional application claiming priority to U.S. Provisional Patent Application No. 61/662,676, filed Jun. 21, 2012, and to U.S. Provisional Patent Application No. 61/831,340, filed Jun. 5, 2013, both entitled "Electrical Connectors for Use with Printed Circuit Boards," the contents of which are incorporated herein by reference in their entirety.

FIELD OF THE DISCLOSURE

The present description relates generally to electrical connectors and more particularly to electrical connectors for use with printed circuit boards.

BACKGROUND OF RELATED ART

Connectors, and more particularly, connectors capable of electrically connecting printed circuit boards ("PCBs") to one another are generally known in the art. For example, U.S. Pat. No. 7,462,036, entitled "Printed Circuit Board Connector for Back Light Unit and Chassis Using the Same," describes a connector for electrically connecting PCBs on which are mounted a plurality of light emitting diodes ("LEDs"). The described connector includes a horizontal supporter, a vertical supporter that divides the horizontal supporter into first and second areas, and at least one connecting terminal formed on the horizontal supporter which is partially exposed in each of the first and second areas of the horizontal supporter. The connecting terminal functions to electrically connect PCBs each having one end placed on the first and second areas, respectively.

U.S. Pat. No. 7,892,022, entitled "Jumper Connector for a Lighting Assembly," also describes a connector for electrically connecting PCBs on which are mounted a plurality of LEDs. The described connector includes a connector body having a mating surface configured to engage more than one PCB. The connector body is configured to be secured to a substrate by a fastener. The connector body additionally includes a conductor and the conductor is configured to be electrically connected to the PCBs during the same step in which the connector body is secured to the substrate. In this manner, the connector body engages the outer surface of the PCBs and simultaneously forces the inner surface of the PCBs into thermal contact with the substrate.

U.S. Published Application No. 2011/0207372, entitled "Electrical Connector With Push-in Termination," describes an edge connector having a first portion adapted to receive an edge of a PCB and a second portion adapted to receive a least one conductor of a stripped end of a wire. The first portion includes at least one terminal assembly and the terminal assembly includes a retention member adapted to engage the conductor via a push-in wire termination. The second portion includes include a terminal portion adapted to releasably engage a contact on a PCB.

U.S. Pat. No. 8,025,507, entitled "Connector," describes a connector for a printed circuit board having a guide hole and a locking hole to receive the connector. The connector includes a housing which is mounted on the printed circuit board and including a guide inserted into the guide hole and a locking unit inserted into the locking hole. Each of the guide and locking unit protrude from the bottom of the housing. In one embodiment, the guide slides into the guide hole and locks into place over the PCB board. In another embodiment, the connector snaps into the PCB board. In either instance, in order to change the PCB board from the support structure underlying the connector, the connector itself must be removed from the PCB and the support structure in order to access the PCB board, thus presenting an oftentimes labor-intensive task.

While the connectors described in each of these publications, which are incorporated herein by reference in their entirety, generally work for their intended purpose, the following describes improved connectors for use with PCBs.

SUMMARY

Described hereinafter are improved connectors for use with PCBs.

More particularly, a connector for electrically connecting a conductor to a first printed circuit board (PCB). A housing is adapted to be moveable relative to a mounting structure to allow the mounting of the PCB to the surface and moveable over the PCB to contact pads located on the top side of the PCB.

Additionally described is a connector for electrically coupling a first PCB with a second PCB is described wherein the connector includes a housing moveably coupled to a base. The housing adapted to provide an electrical connection to each of the first and second PCBs having exposed contact pads formed on a top side of the respective PCBs. While at least one example connector described herein includes a housing moveable relative to a base attached to a mounting structure, it will be appreciated by one of ordinary skill in the art that the connector may simply include a housing directly coupleable to the mounting structure itself such that the housing is moveable relative to the mounted PCB.

Also described is a connector for electrically connecting a first PCB with a second PCB wherein the connector includes a housing and at least one connecting terminal carried by the housing having at least partially exposed opposed ends each of which electrically engages a contact pad formed on a top side of the respective PCBs and wherein the connector is adapted to allow the edges of the PCBs to be placed into direct contact.

Yet further is described a connector for electrically connecting a first PCB with a second PCB wherein the connector includes a housing and at least one connecting terminal carried by the housing having at least partially exposed opposed ends each of which electrically engages a contact pad formed on a top side of the respective PCBs and wherein the connecting terminal is arranged to accept a conductor and to thereby electrically couple the conductor to the first and second PCBs.

Still further is disclosed another example bridging connector for electrically connecting a first PCB with a second PCB wherein the connector includes a non-conductive housing and at least one connecting terminal carried by the housing having opposed ends each of which are electrically engageable with a contact pad, or other contact terminal, formed in a top side of the respective PCBs. A resilient holding element, such as for example a spring clip, is engageable with at least one of the PCBs and/or a surface supporting the PCB(s) to releasably retain the housing and the terminals in the correct location.

Likewise disclosed is another example end connector for electrically connecting a PCB to an external device, such as for instance a power supply. The described example end connector includes a non-conductive housing and at least one connecting terminal carried by the housing having a first end electrically engageable with a contact pad, or other contact terminal, formed in the top side of the PCB, and a second end for engaging and retaining an electrical conductor, such as for example a wire. In one example, the second end may include a push-in type terminal for semi-permanently retaining an inserted wire therein. The housing of the end connector may be similarly retained against the PCB by a resilient holding element, such as, for example a spring clip, engageable with at least one of the PCB and/or a surface supporting the PCB.

While the foregoing provides a general description of the subject assemblies for holding a source of LED light and some advantages thereof, a better understanding of the objects, advantages, features, properties, and relationships of the subject assemblies will be obtained from the following detailed description and accompanying drawings which set forth illustrative embodiments and which are indicative of the various ways in which the principles of the invention may be employed.

DETAILED DESCRIPTION

The following description of example methods and apparatus is not intended to limit the scope of the description to the precise form or forms detailed herein. Instead the following description is intended to be illustrative so that others may follow its teachings.

By way of non-limiting example, the improved connectors described herein provide a low profile to reduce or eliminate shadowing of light from any LEDs mounted on the PCBs, allow PCBs to be placed adjacent to one another without breaks for continuous lighting, allow for easy replacement of PCBs, allow for vertical replacement of PCBs, eliminate the need to solder together PCBs and connectors, require fewer connectors than traditional devices, provide for near-continuous lighting with fewer dark spots due because connectors are not required at the ends of the PCBs, etc.

It will also be appreciated that single sided PCBs are oftentimes less expensive to manufacture then PCBs having components on two sides, and typically the bottom side of the PCB is placed against a supporting substrate, such as sheet metal. Thus, the presently described connector provides a device that takes advantage of the preferable single-sided PCB arrangement.

Turning now to the Figures, wherein like elements are referenced using common identifiers, illustrated are various connectors for use with printed circuit boards ("PCBs"). By way of non-limiting example, a plurality of PCBs 10 may have mounted thereon one or more light emitting diodes ("LEDs") 11 which LEDs are, in turn, electrically coupled to one or more contact pads 12 formed on a top side of the PCBs 10 as illustrated in FIGS. 1A, 1B, and 1C.

Figure 1A:
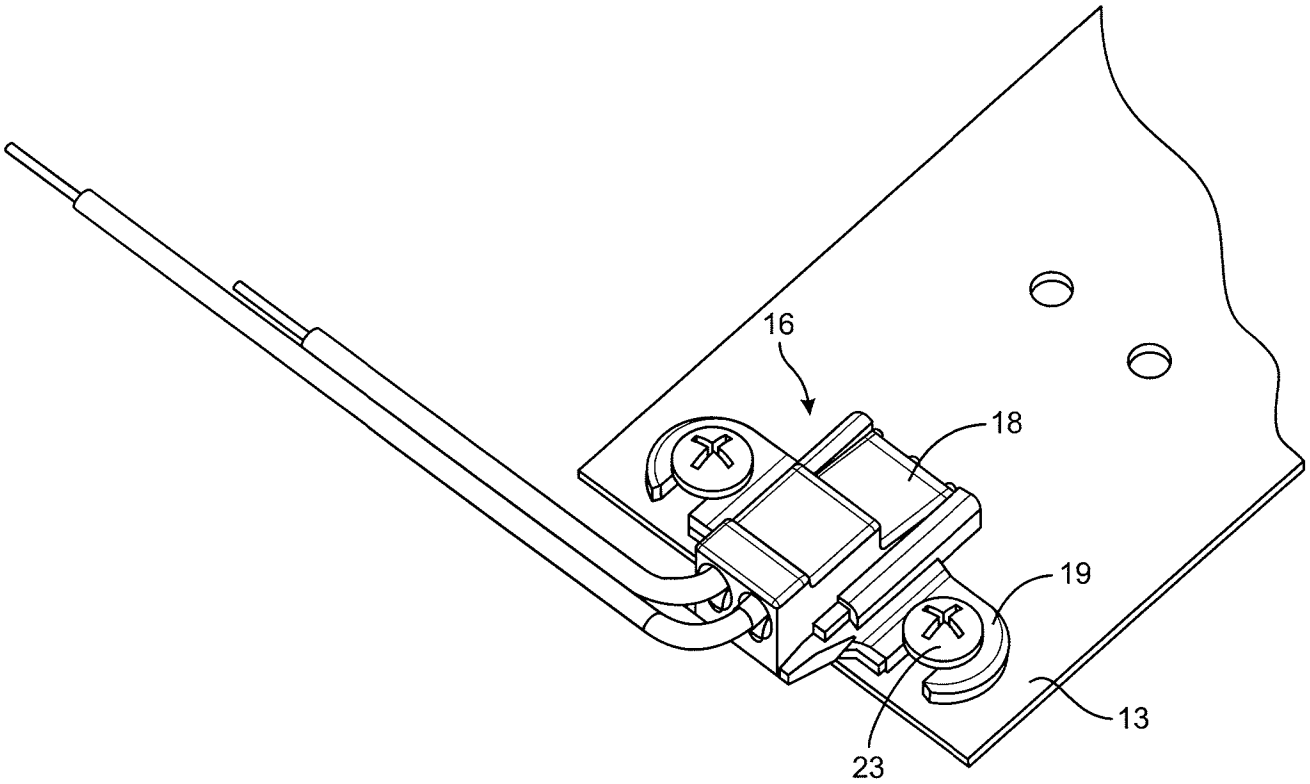
FIGS. 1A-1C together illustrate an example method of electrically coupling a conductor to an example printed circuit board (PCB).
Figure 1B:
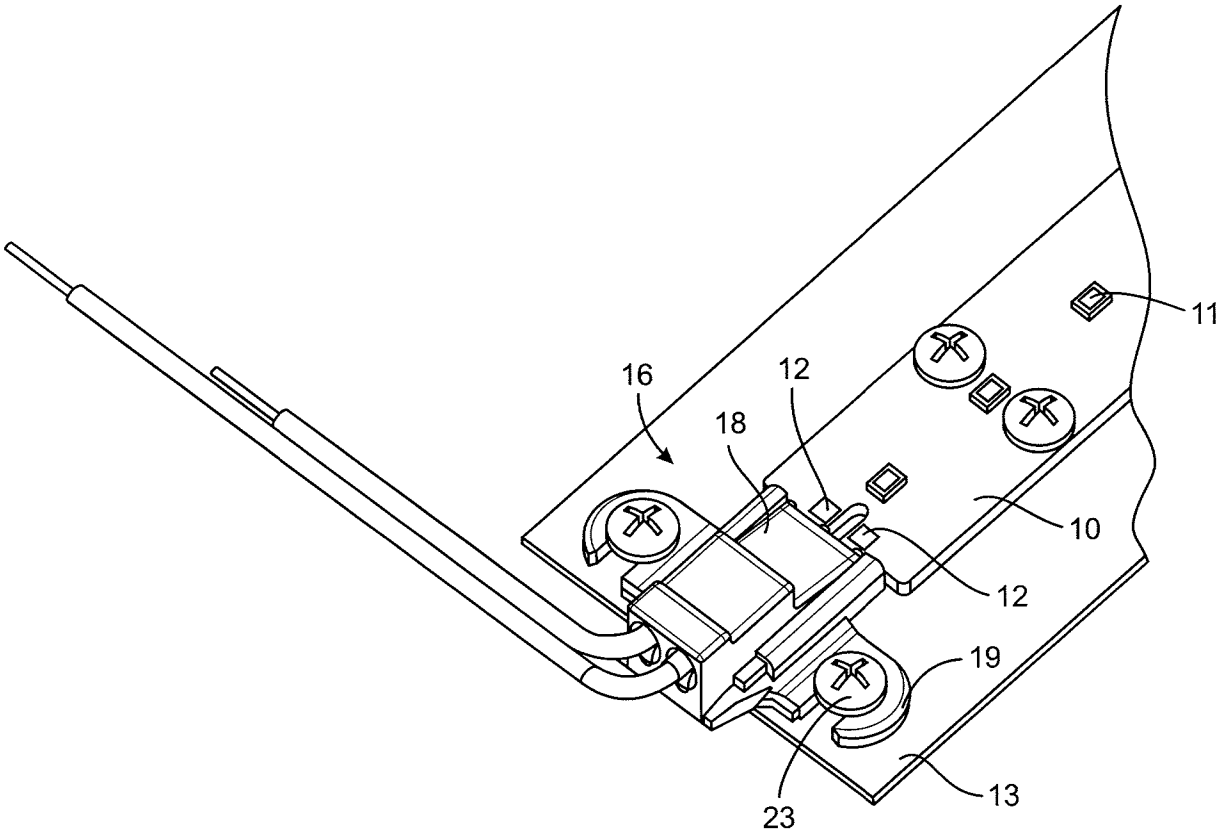
Figure 1C:
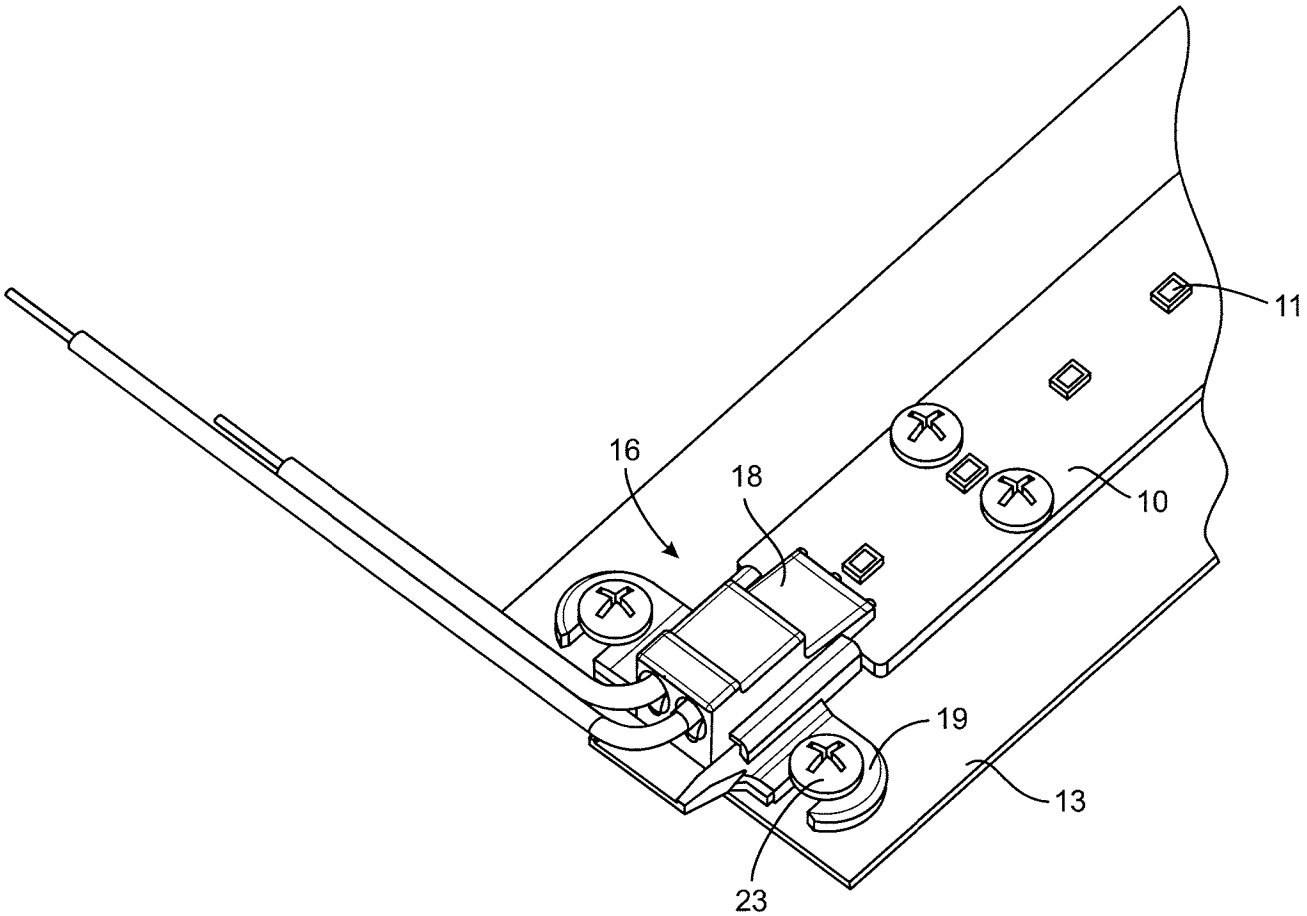
Figure 2:
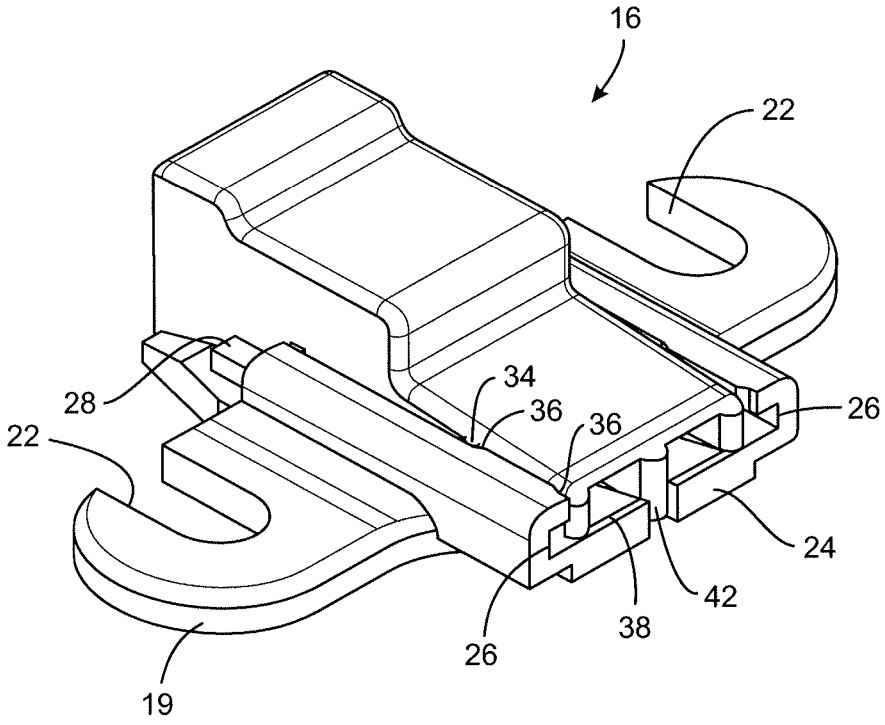
FIG. 2 is a front perspective view of an example connector of the present disclosure.
Figure 3:
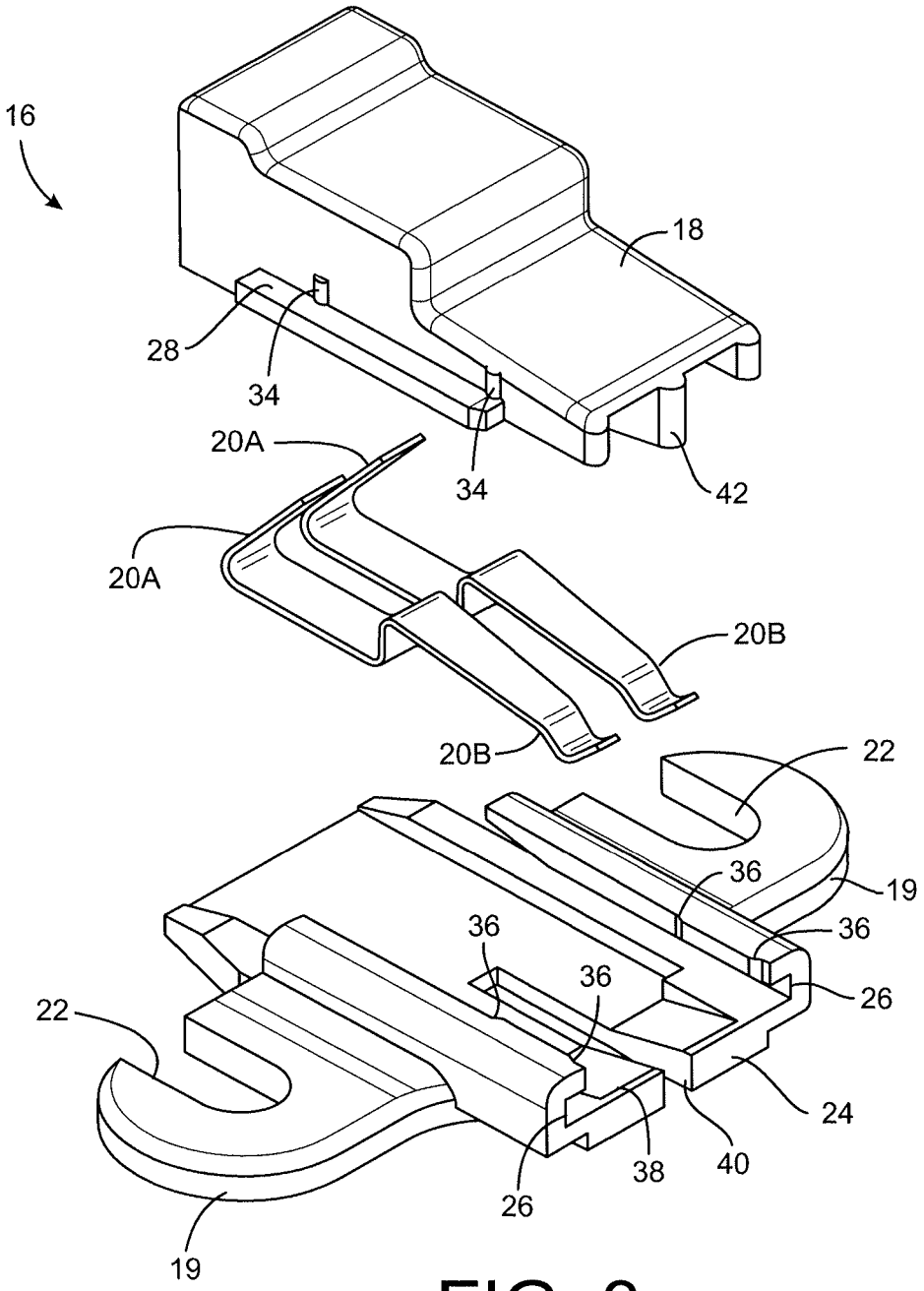
FIG. 3 is an exploded front perspective view of the example connector of FIG. 2.

For providing an electrical connection to the PCB 10 as illustrated in FIGS. 1A-1C, a connector 16 is illustrated in detail in FIGS. 2-5. The example connector 16 includes a housing 18 formed using an electrically insulating material, such as plastic. The housing 18 carries one or more connecting terminals 20, such as, for example, push-in type electrical terminals. Opposite ends of the connecting terminals 20 are arranged to receive an electrical conductor and to engage the contact pads 12 provided on the top side of a PCB 10. The housing 18 is slidably mountable to a base 19 that includes connection means, such as apertures 22 for mounting the base 19 to a mounting structure 13, such as for example a mounting or support surface supporting the PCBs 10. In this example, the apertures 22 are sized to accept fasteners 23 (see FIGS. 1A, 1B, 1C) such as screws, rivets, and/or any other suitable connector.

For example, as illustrated, the base 19 may be mounted to the mounting structure 13, such as for example, a heat sink, with the PCBs 10 then being mounted to the mounting structure 13 such that an end 24 the base 19 is essentially flush with a side of each of the PCBs 10 proximate the contact pads 12 as particularly shown in FIGS. 1A, 1B. In the illustrated example, the apertures 22 are defined with an adjustment means, such as a slot, to allow horizontal adjustment of the base 19 against the PCBs 10. In this example, the apertures 22 defined by the base 19 are open ended and are positioned such that base 19 can slide under a lip, or other retention device, of the fastener 23. As will be appreciated, in this instance, the open end of the aperture 22 is defined such that the base 19 cannot be removed from the fastener 23 when a PCB 10 is installed proximate the connector 16 based upon contact of the PCB 10 with the end 24 of the base 19.

Figure 4:
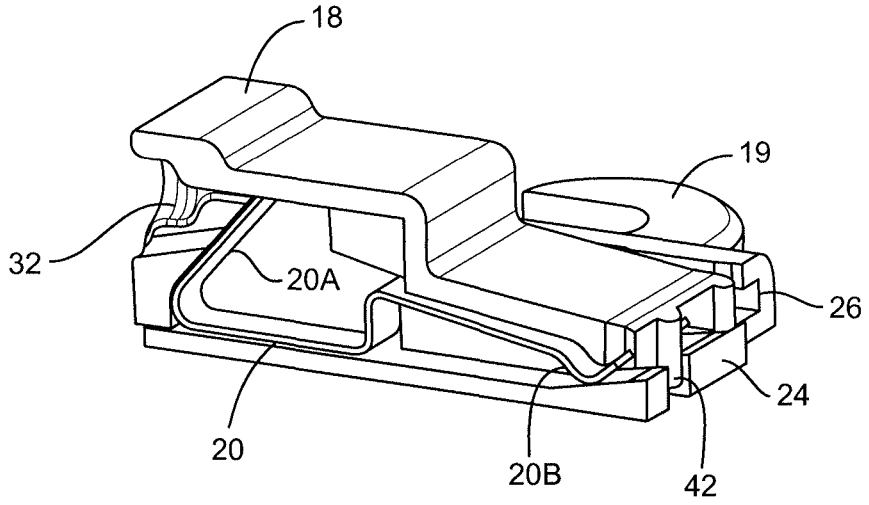
FIG. 4 is cross-section front perspective view of the example connector of FIG. 2.
Figure 5:
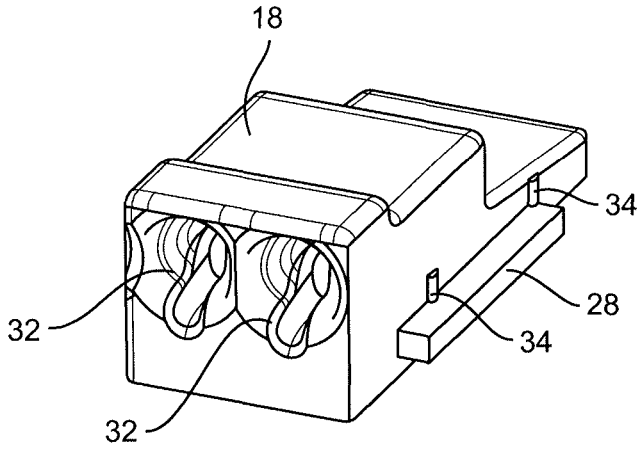
FIG. 5 is a rear perspective view of the housing of the example connector of FIG. 2.

The example housing 18, defines a cavity 30 for housing the connecting terminals 20. The connecting terminals 20 have elasticity to thereby facilitate engagement with the contact pads 12 of the PCBs 10. More particularly, a first end 20A of the connecting terminal 20 includes a flexible push-in type connector region to allow insertion and retention of an electrical conductor, such as for example, a wire, in the housing 18. As illustrated in FIGS. 4 and 5, the housing 18 defines wire guide apertures 32 to permit insertion of the electrical conductors in to the housing 18. A second end 20B of the contacting terminals 20 that are exposed in the cavity 30 of the housing 18 may be curved and arranged over an open side, a hole, a slot, a recess, or the like formed in the housing so that the end of the connecting terminal 20 is positionable generally above and in contact with the PCBs 10 and more specifically, with the contact pads 12.

For providing a slidable interface between the housing 18 and the base 19, the example base 19 includes a pair of opposing channels 26 formed in either side of the base 19 for slidably capturing a lip 28 formed on opposite sides of the exterior surface of the housing 18. As will be described, the example housing 18 is coupled to the base 19 such that the housing 18 cannot be removed from the base 19 under normal operating conditions. More particularly, while the example base 19 and housing 18 are separately formed, once coupled, the two parts cannot be easily separated. It will be appreciated, however, that in other examples, the housing 18 may be removable from the base 19. Still further, it will be appreciated that the base 19 and the housing 18 may be integrally formed such that mating of the two parts is not necessary.

In addition to the example lip 28, the example housing 18 includes at least one detent 34 that may correspond to a cooperating notches and/or cam surface 36 formed proximate to the channels 26 to catch and/or temporarily lock the movement of the housing 18 relative to the base 19, and/or to provide the user with physical, visual, and/or audible cues regarding the proper seating of the housing 18 relative to the base 19.

Still further, the example base 19 may include a ramp 38 or other suitable surface to assist in moving the end 20B of the connecting terminal 20 over the edge of the PCB 10 and into contact with the corresponding contact pad 12 when the housing 18 is slidably moved over the base 19 towards the PCB 10. To assist in directing and/or controlling the sliding motion of the housing 18 relative to the base 19, the connector 19 may also include a channel 40 formed in the base 19 and sized to accept an extending tab 42 protruding from the housing 18 therein.

Figure 6:
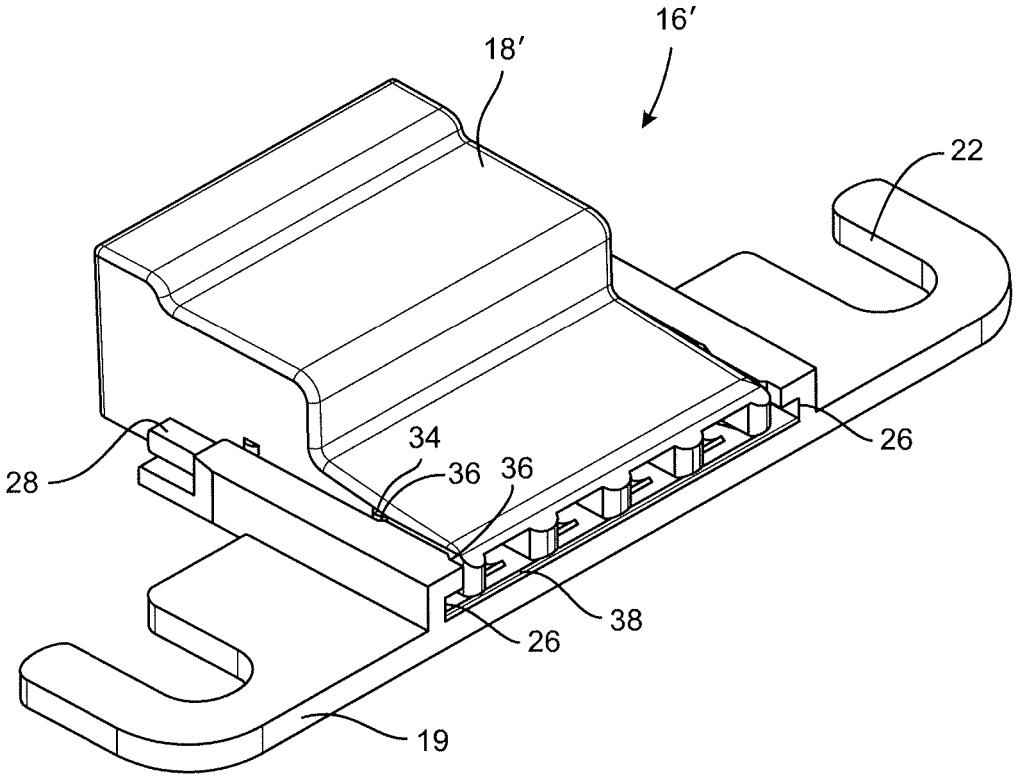
FIG. 6 is a front perspective view of an example connector of the present disclosure.
Figure 7:
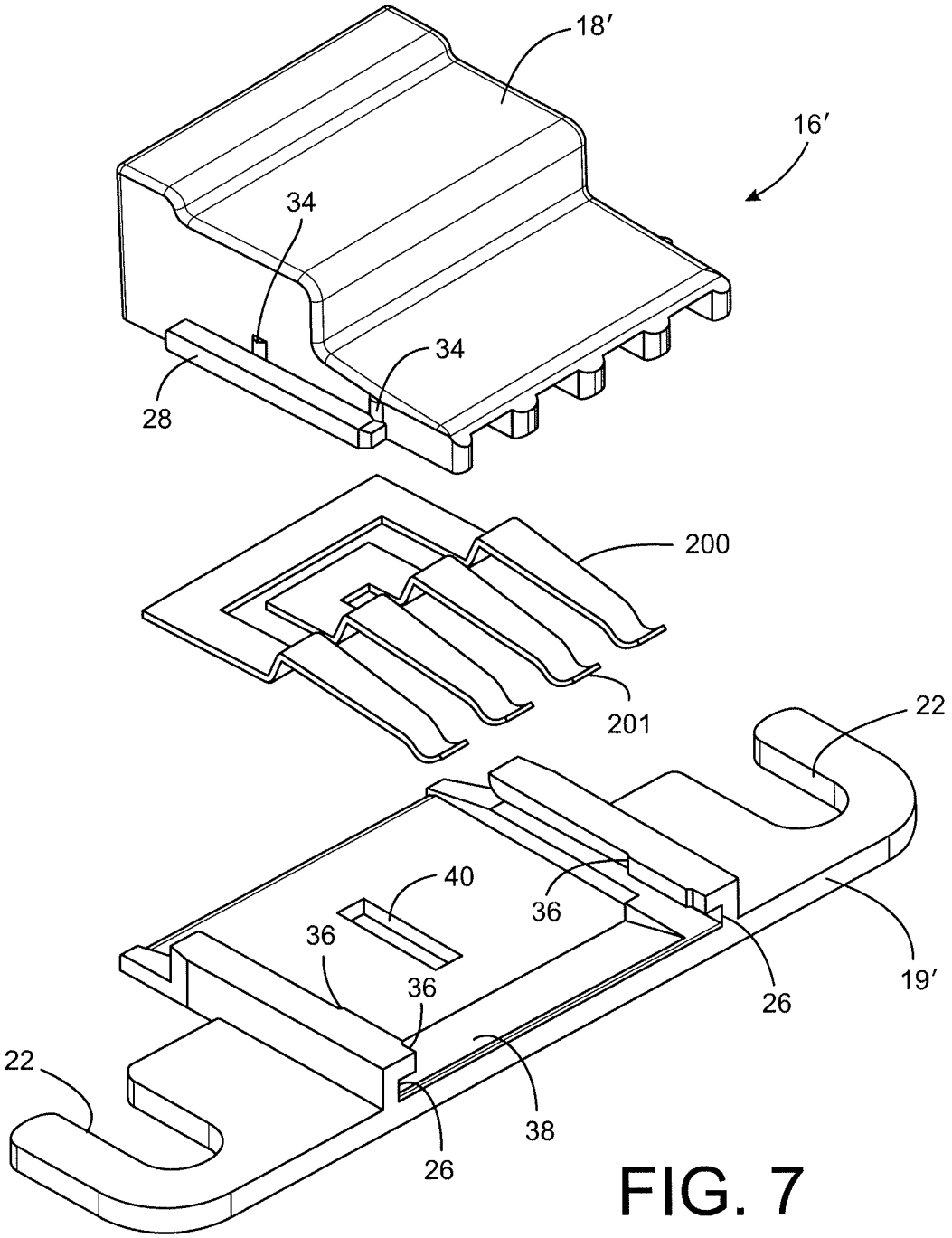
FIG. 7 is an exploded front perspective view of the example connector of FIG. 6.

Turning now to FIGS. 6 and 7, for providing an electrical connection between two PCBs 10, an example center bridge connector 16'. The example center bridge connector 16' includes an elongated housing 18' similarly formed using an electrically insulating material, such as plastic. The housing 18' carries one or more bridging terminals, such as for example, an outer terminal 200 and an inner terminal 201. In this example, the housing 19' does not include any wire guide apertures 32, as the connector 19' is merely intended as a bridge, but it will be appreciated by one of ordinary skill in the art that the housing 19' may be provided with any number and/or type of wire guide apertures as desired. Opposite ends of the connecting terminals 200, 201 are arranged to engage the contact pads 12 provided on the top side of a PCB 10 and to electrically couple two PCBs 10 together.

The housing 18' is similarly slidably mountable to an elongated example base 19' that is connectable to the mounting structure 13 in a similar fashion as the connector 16. For instance, the example base 19' includes apertures 22 for mounting the base 19' to the mounting structure 13 supporting the PCBs 10, wherein the apertures 22 are sized to accept fasteners 23 (see FIGS. 1A, 1B) such as screws, rivets, and/or any other suitable connector.

Figure 8:
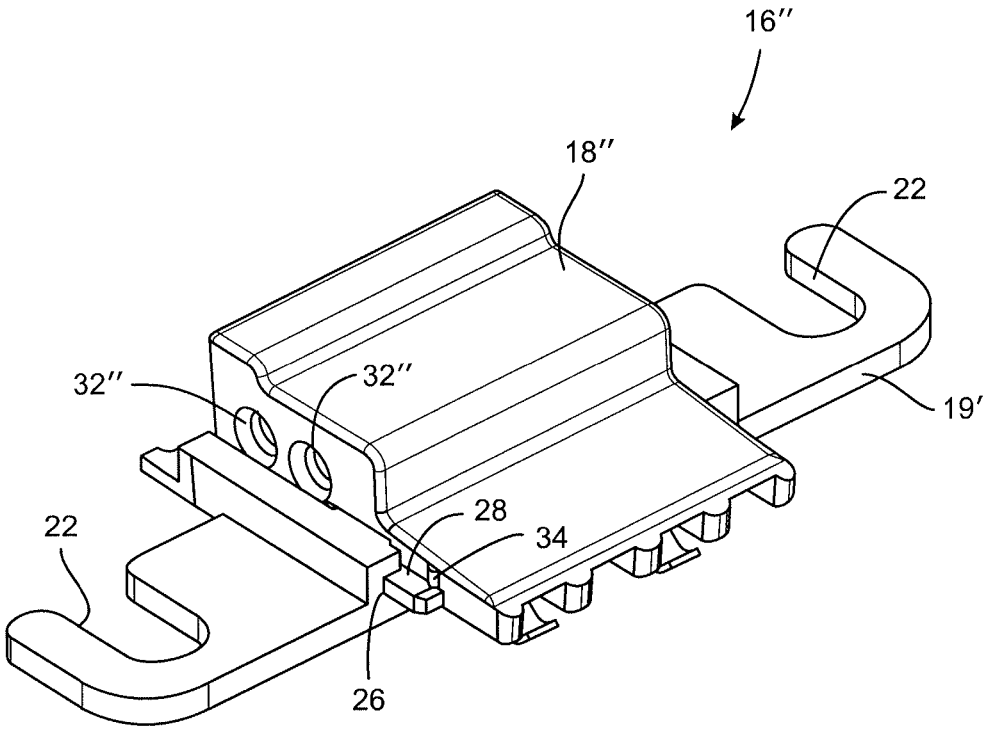
FIG. 8 is a front perspective view of an example connector of the present disclosure.
Figure 9:
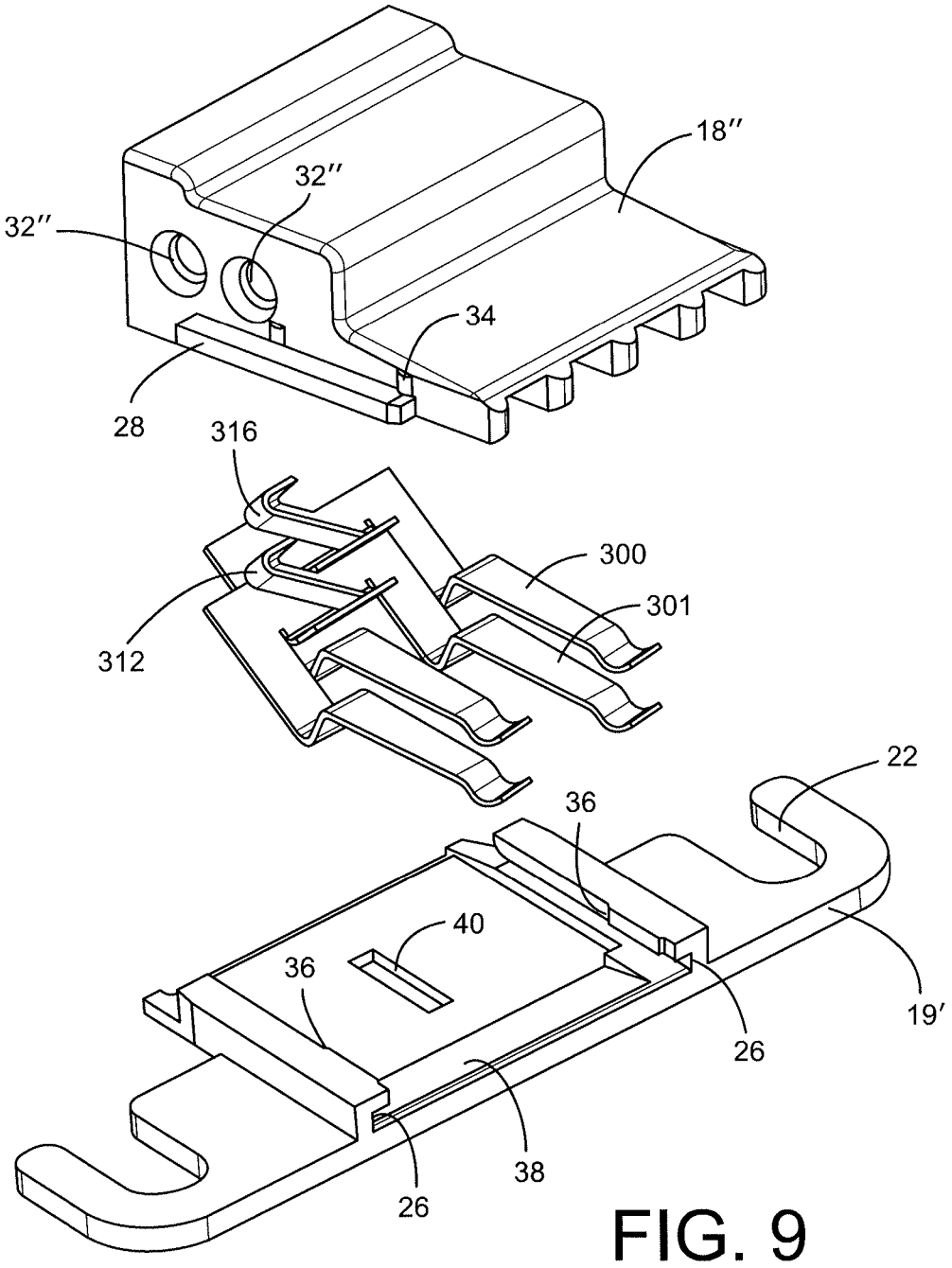
FIG. 9 is an exploded front perspective view of the example connector of FIG. 8.

Turning now to FIGS. 8 and 9, for providing an electrical connection between two PCBs 10, a bridging electrical connector 16" is illustrated. As similar to the previous examples, the example connector 16" includes an elongated housing 18" formed using an electrically insulating material, such as plastic. The housing 18" carries one or more bridging terminals, such as for example an outer terminal 300 and an inner terminal 301. In this example, each of the terminals 300, 301 include a push-in type electrical terminal for receiving a conductor, such as a wire, and for bringing an electrical connection between pads 12 on the top surface of two PCBs 10.

In this instance, the example housing 18" includes wire guide apertures 32" formed in the side of the housing 18". Opposite ends of the connecting terminals 200, 201 are arranged to engage the contact pads 12 provided on the top side of a PCB 10 and to electrically couple two PCBs 10 together, while connecting terminals 310, 312 include a flexible push-in type connector region to allow insertion and retention of an electrical conductor, such as for example, a wire, in the housing 18". In this fashion, the connector 16" is capable of both bridging two PCBs 10 and providing an electrical connection thereto.

As with the previous examples, the example housing 18" is slidably mountable to an elongated example base 19' that is connectable to the mounting structure 13 in a similar fashion as the connector 16. For instance, the example base 19' includes apertures 22 for mounting the base 19' to the mounting structure 13 supporting the PCBs 10, wherein the apertures 22 are sized to accept fasteners 23 (see FIGS. 1A, 1B) such as screws, rivets, and/or any other suitable connector.

Figure 11:
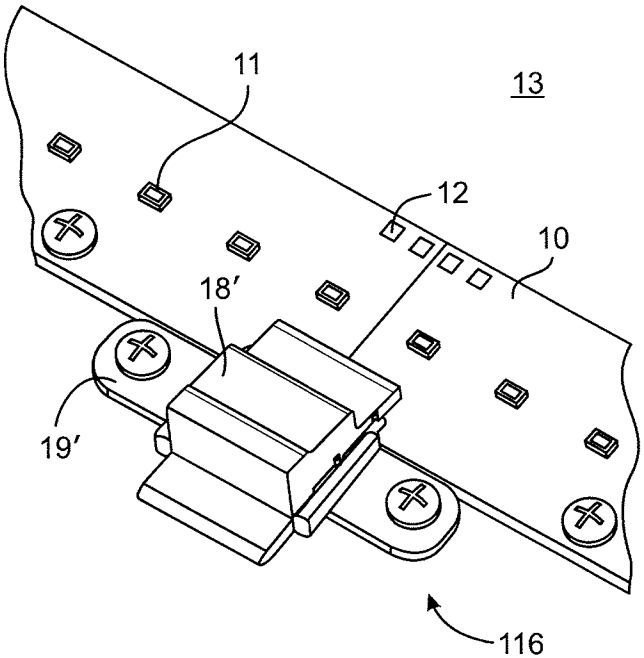
FIG. 11 is a front perspective view of the example connector of FIG. 10 showing the connector in a closed position.
Figure 10:
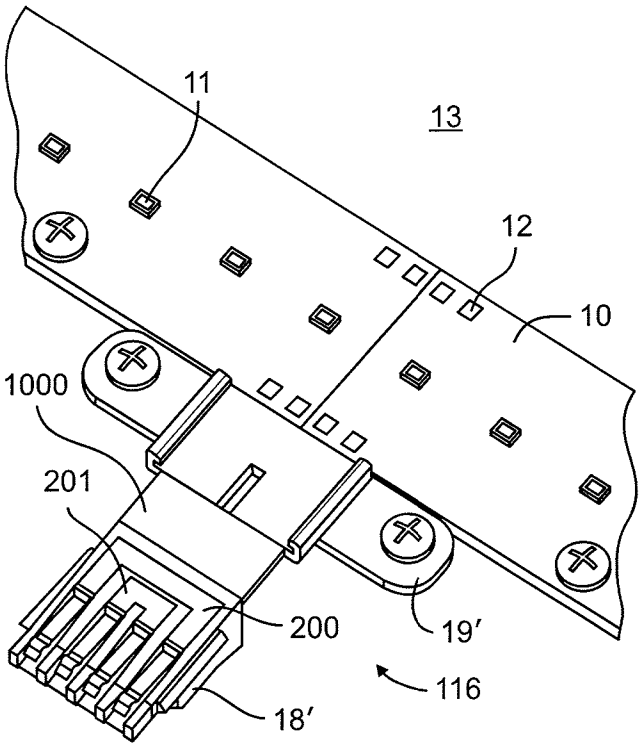
FIG. 10 is a front perspective view of an example connector of the present disclosure showing the connector in an open position.
Figures 12A, 12B, 12C:
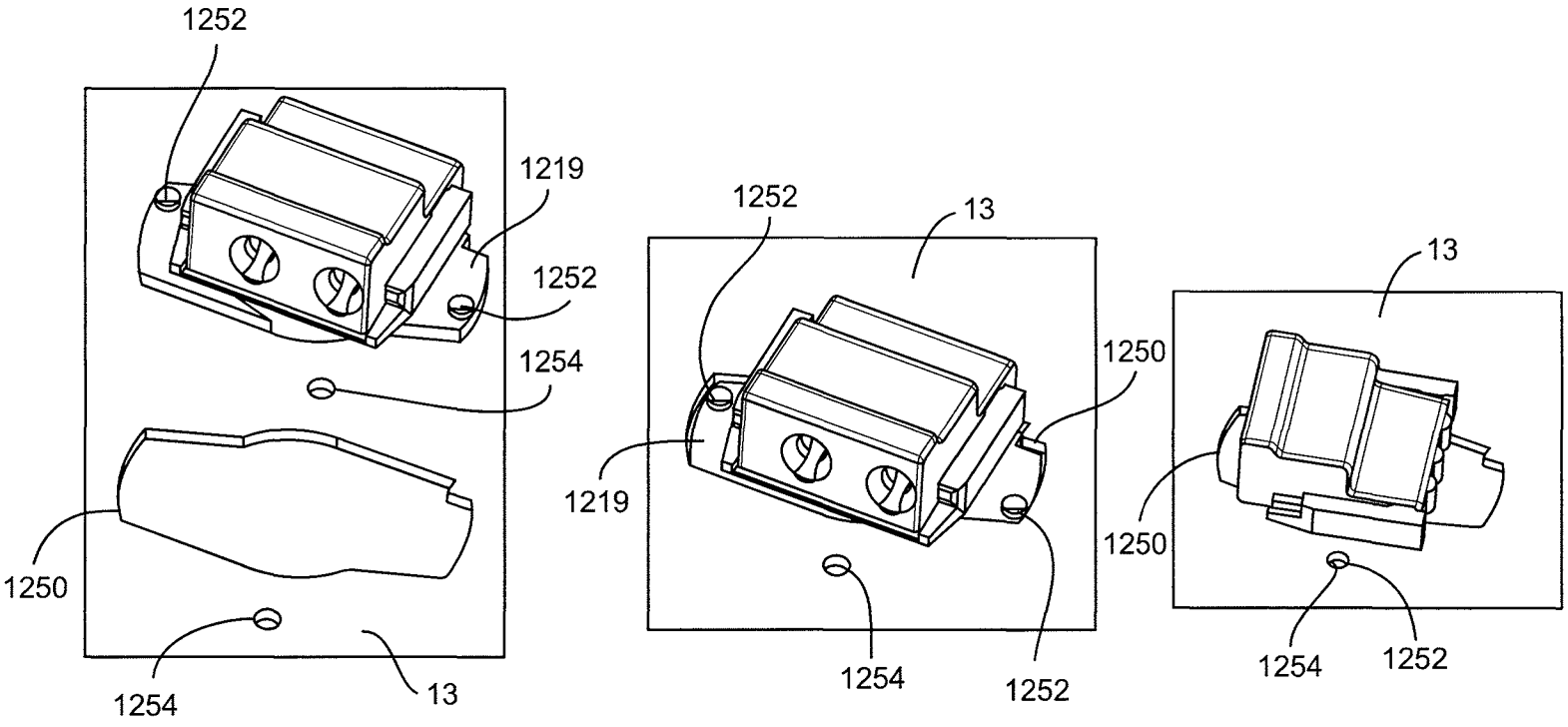
FIGS. 12A-12C together illustrate an example method of mounting an example connector of the present disclosure to a mounting structure.

Referring to FIGS. 10 and 11, there is illustrated another example connector 116, wherein the housing 18 and the base 19 are pivotally coupled, such as for example via a hinge, instead of slidably coupled as with the previous example connectors 16, 16', 16". In particular, in the illustrated example, the connector 116 includes a base 19' and a housing 18' pivotally coupled via a hinge 1000. As will be appreciated by one of ordinary skill in the art, while the pivotal arrangement in this example is via a flexible hinge, the pivotal arrangement may be any suitable device including pivot points and/or complex motions including both pivoting and/or sliding motion as desired.

As shown in operation, the connector 116 and the PCBs 10 are fastened to the mounting structure 13 and the housing 18' is pivotally rotated about the hinge 1000 to contact the pads 12 on the top surface of the PCBs 10. The housing 18' may be releasably held in contact with the pads 12 by "snap-fit" and/or other suitable fitting mechanism between the housing 18' and the base 19'. Still further, while the present pivotal connector 116 is illustrated as being rotatable after installation of the PCB 10, it will be readily apparent that the connector 116 may be rotated and "locked" (e.g., closed) prior to installation of the connector 116 on the mounting structure 13. In other words, the closed connector 116 may be installed directly over the already mounted PCB 10. Still further, the connector 116 may be closed an installed on the mounting structure 13 prior to installation of the PCB 10, thus requiring the PCB 10 to have to slide under the closed connector 116 for installation.

FIGS. 12A-12C and FIGS. 13A-13C each illustrate and alternative method of fastening the base of the various example connector to the mounting structure 13. In particular, in the example of FIGS. 12A-12C, the connector includes housing (e.g., housing 18, 18', 18", etc.) and a base 1219 that is twistable into mating relationship with the mounting structure 13. In this instance, the mounting structure 13 is provided with an aperture 1250 sized to accept the base 1219 therethrough. The example base 1219, meanwhile is provided with at least one detent such as a post 1252 extending from the surface of the base 1219 proximate the housing of the connector. To install the connector, the base 1219 is inserted through the aperture 1250 and twisted relative to the mounting structure 13 to rotate the base 1219 below the mounting structure and to bring the post 1252 into engaging contact with retention holes 1254 formed in the mounting structure 13. Once installed, the housing is free to pivot and/or slide relative to the base 1219 as previously described.

Figures 13A, 13B, 13C:
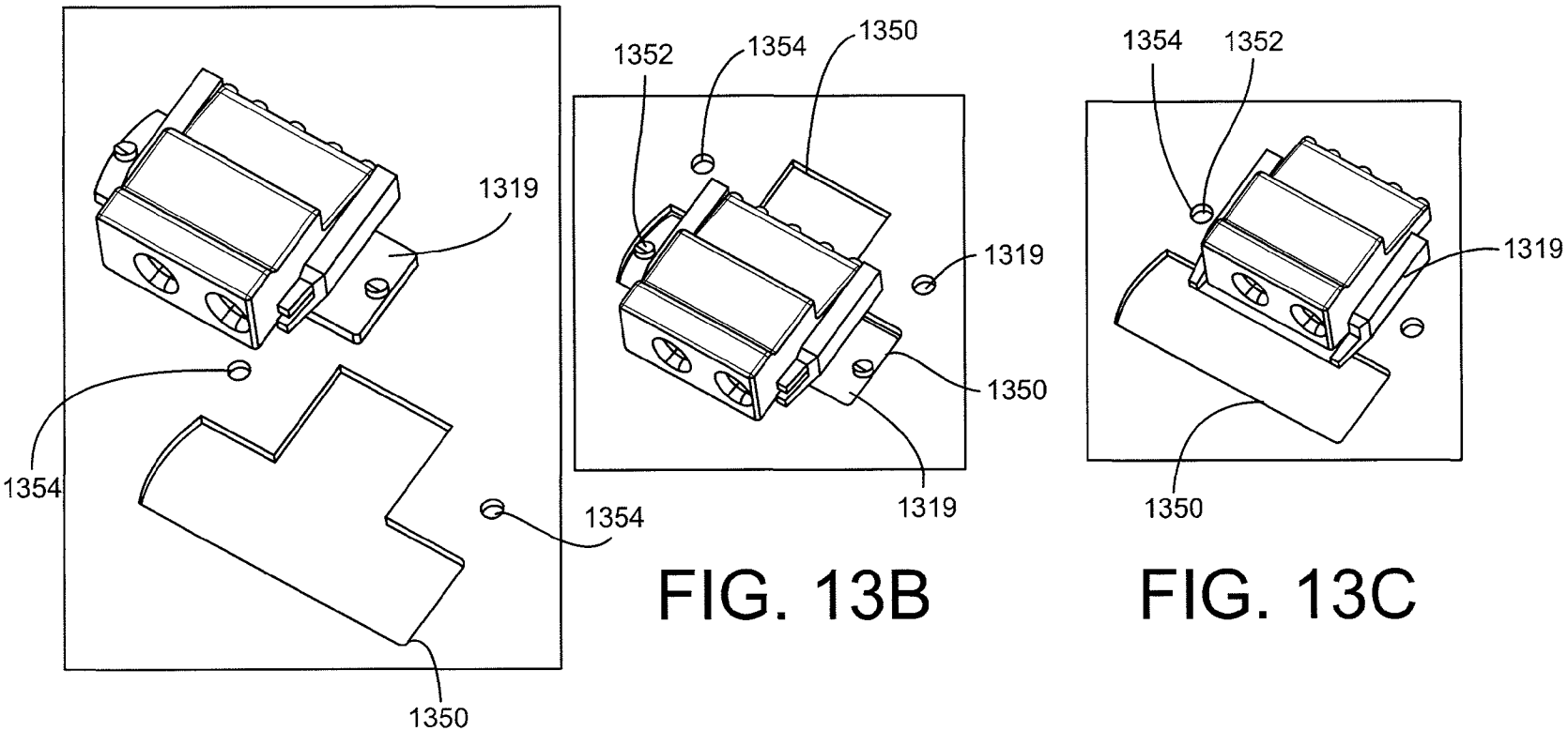
FIGS. 13A-13C together illustrate an example method of mounting an example connector of the present disclosure to a mounting structure.

In the example of FIGS. 13A-13C, the connector includes housing (e.g., housing 18, 18', 18", etc.) and a base 1319 that is slidable into mating relationship with the mounting structure 13. In this instance, the mounting structure 13 is provided with an aperture 1350 sized to accept the base 1319 therethrough. The aperture 1350 is elongated in that it is provided with a slot to allow the base 1319 to slide relative to the mounting structure 13 towards locking engagement with the mounting structure 13. The example base 1319, is similarly provided with at least one detent such as a post 1352 extending from the surface of the base 1319 proximate the housing of the connector. To install the connector, the base 1319 is inserted through the aperture 1350 and slid relative to the mounting structure 13 to move the base 1319 below the mounting structure 13 and to bring the post 1352 into engaging contact with retention holes 1354 formed in the mounting structure 13. As with the previous example, once installed, the housing is free to pivot and/or slide relative to the base 1319 as previously described.

Figure 14A:
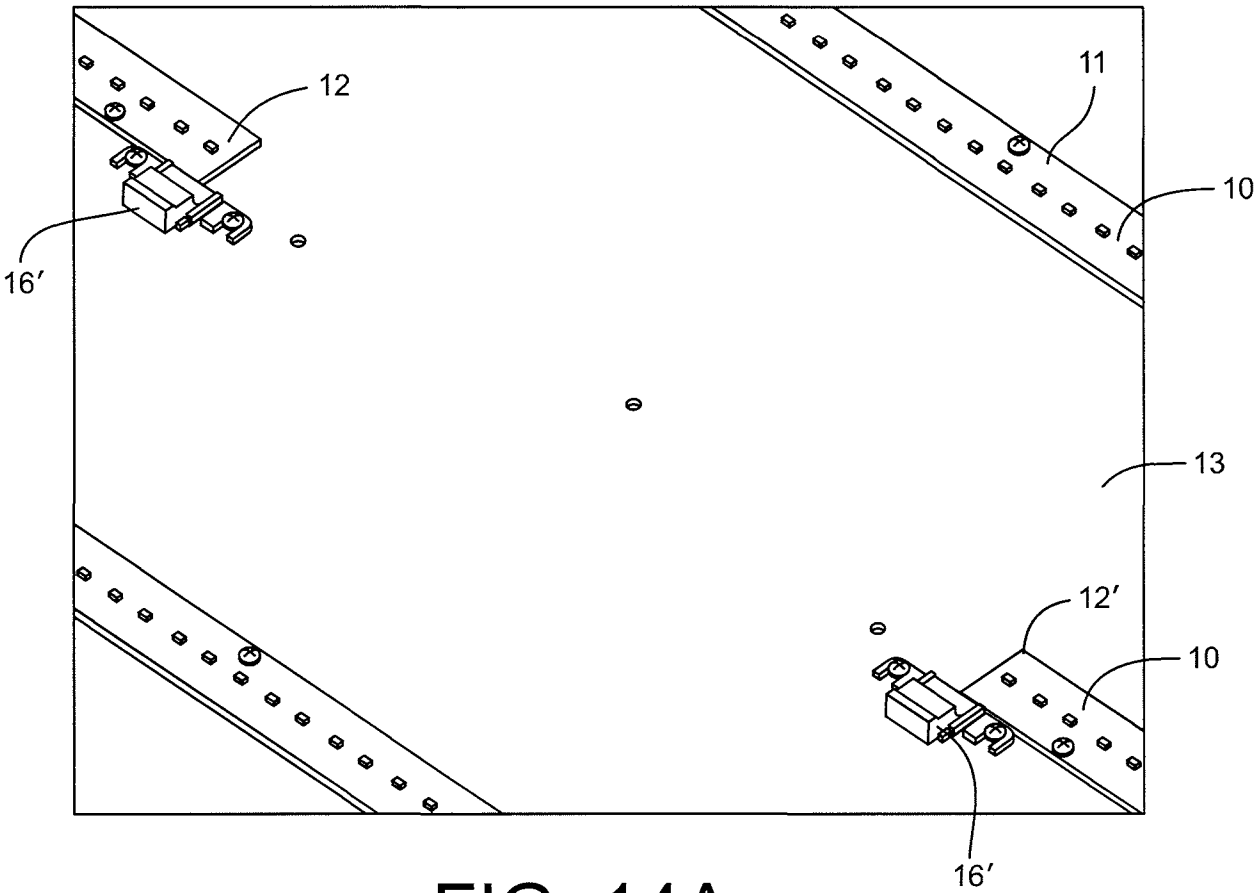
FIGS. 14A-14D together illustrate an example method of electrically bridging two example printed circuit boards with an example connector of the present disclosure.
Figure 14B:
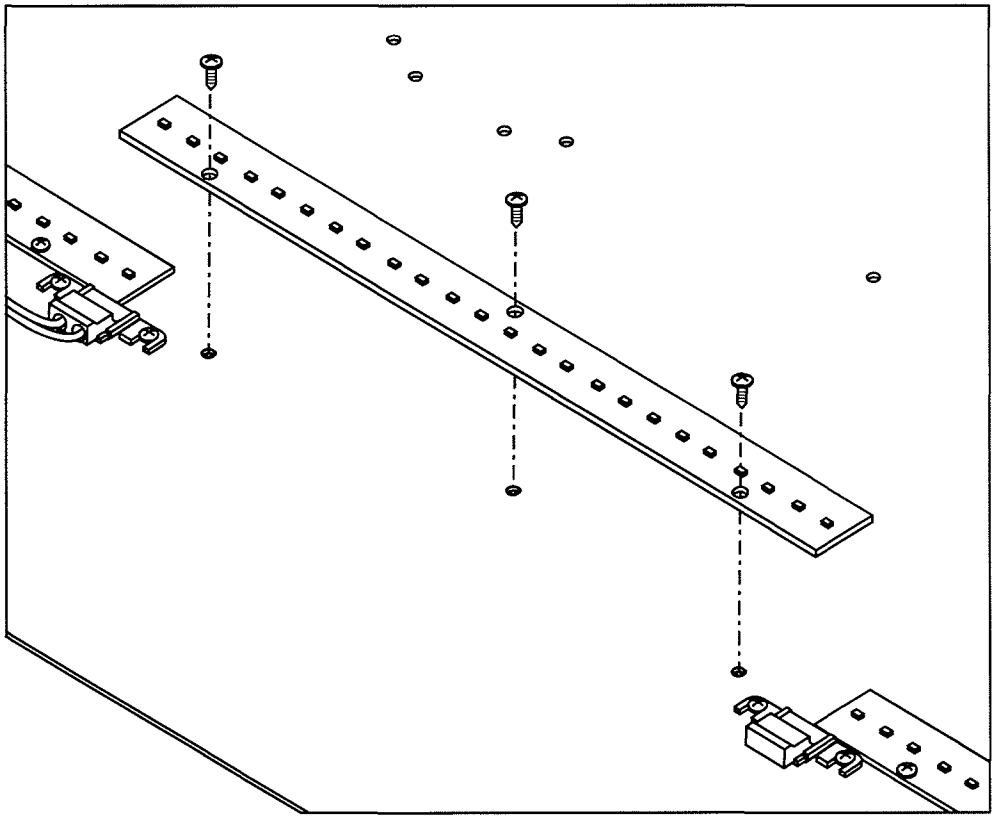
Figure 14C:
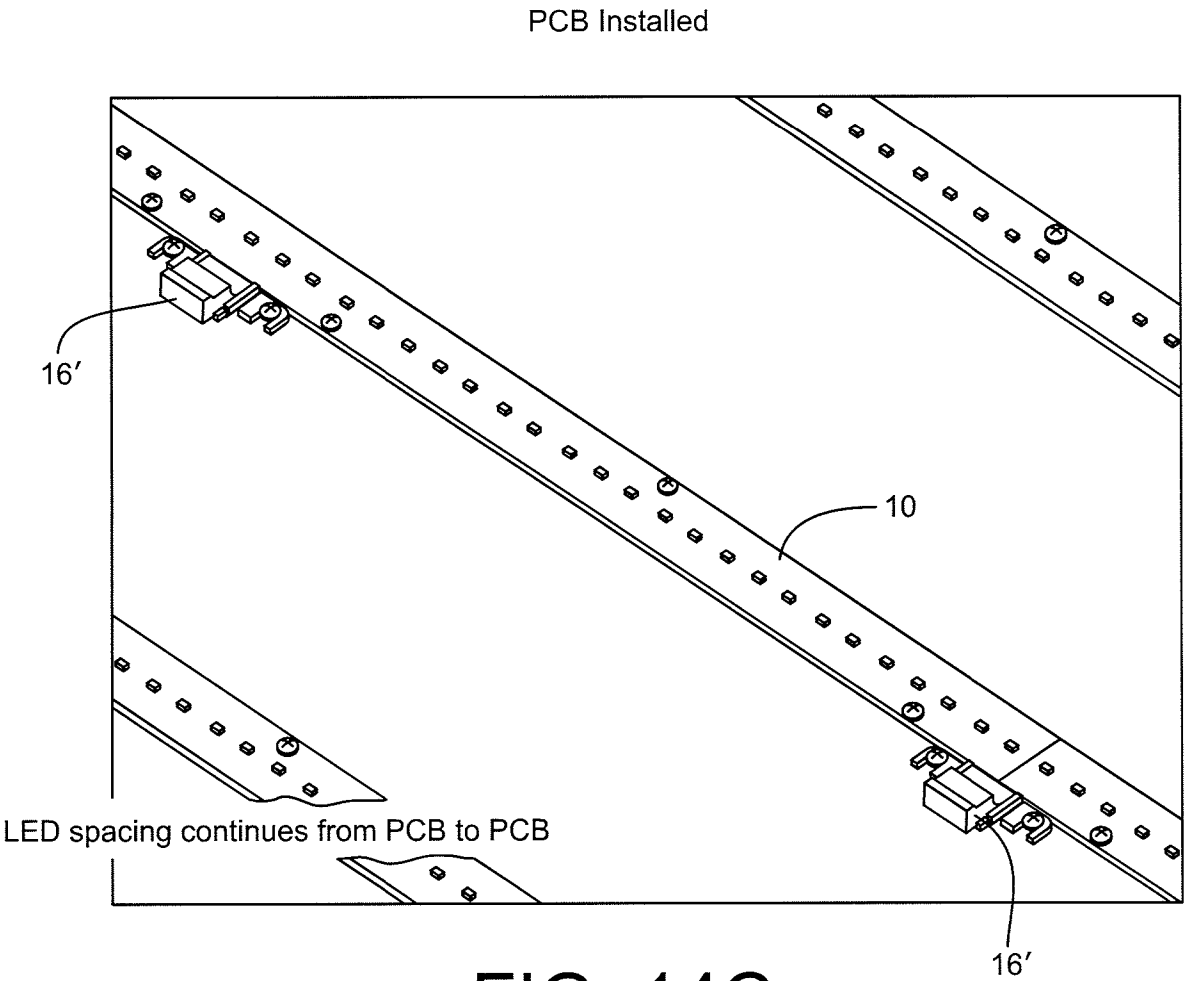
Figure 14D:
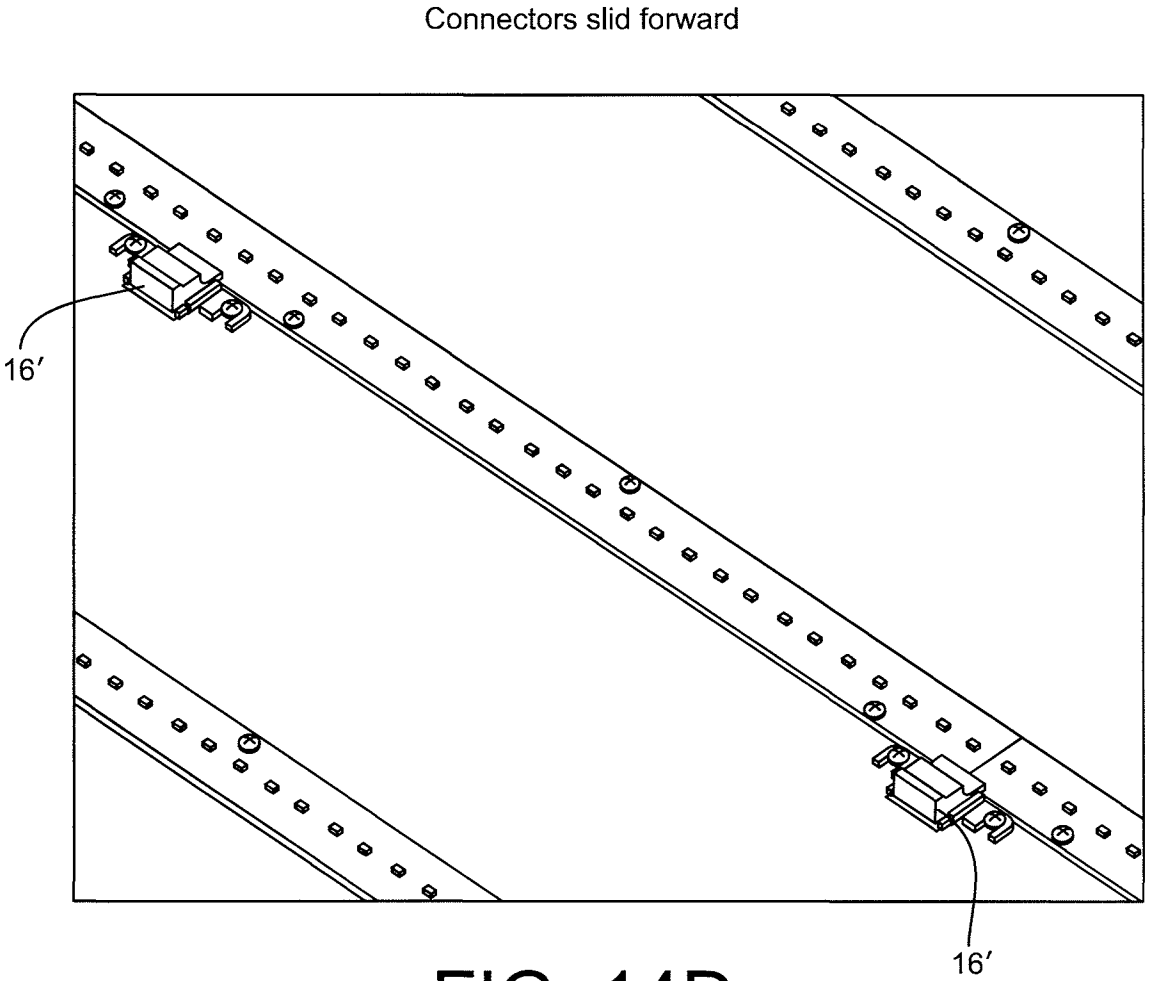

FIGS. 14A-14D illustrate an example of the connector 16' as it is installed on a mounting structure 13 and over a plurality of PCBs 10. In this example, two example connectors 16' are mounted to the surface 13 in FIG. 14A. The PCB 10 is then installed as illustrated in FIG. 14B. As previously noted, the PCB 10 can be installed and/or removed substantially vertically relative to the mounting structure 13. With the PCB 10 installed (FIG. 14C), the connector 16' is slid into engagement with the contact pads 12 of the PCB 10 as shown in FIG. 14D.

Figure 15:
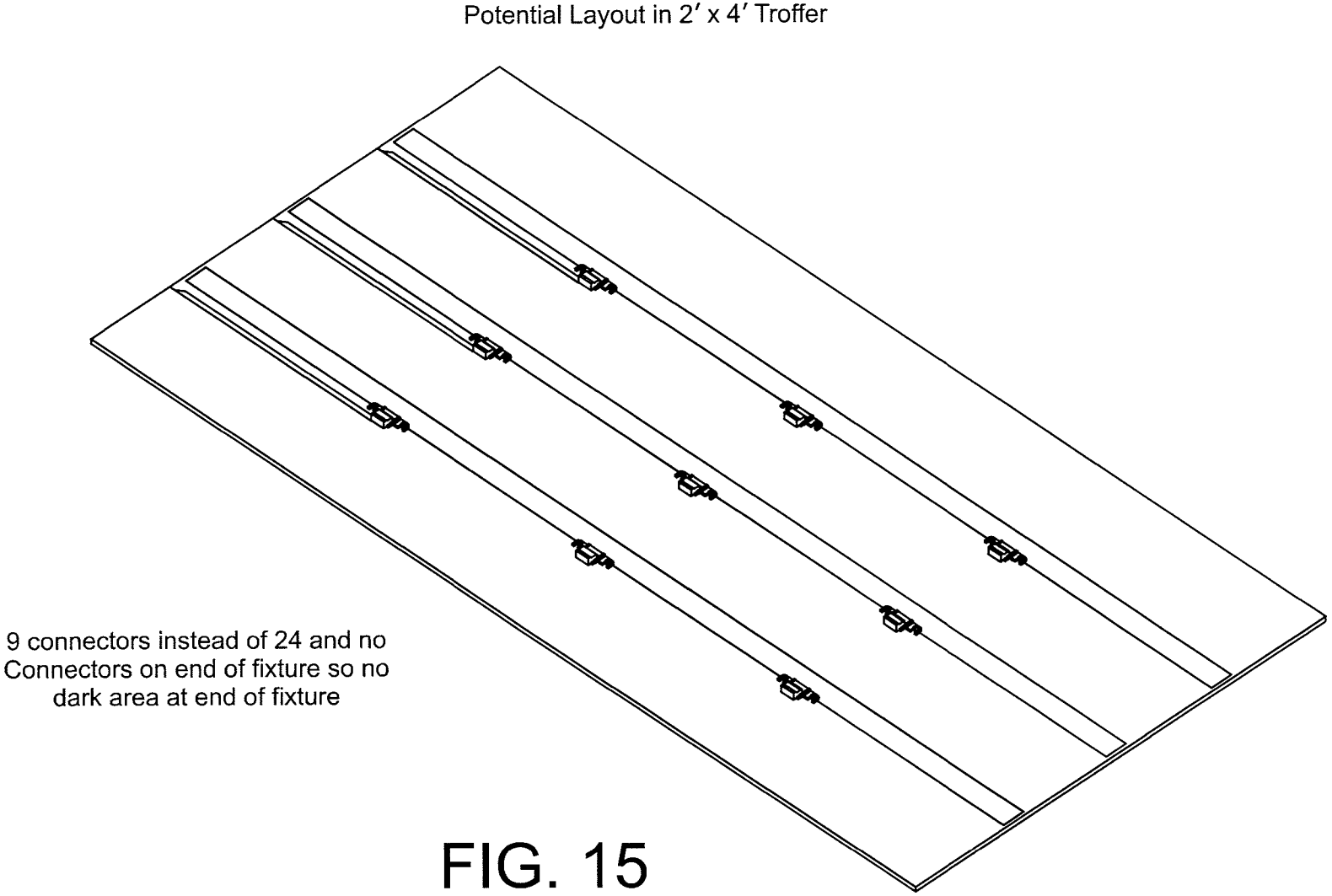
FIG. 15 illustrates an example layout of a troffer utilizing the connector of the present disclosure.

FIG. 15 illustrates one example layout of the connectors of the present disclosure as used in an example fixture such as a troffer, which in this example is an inverted trough serving as a support and reflector usually for a fluorescent lighting unit. In the illustrated example, the presently disclosed connectors allow for as few as nine connectors instead of the typical twenty four connectors previously required by known connectors (e.g., four PCBs per row, with one connector at each end, in three rows, for twenty four connectors). Additionally, the present layout does not require any connector at the end of the troffer fixture such that any dark area at the end of the fixture is minimized.

Figure 17:
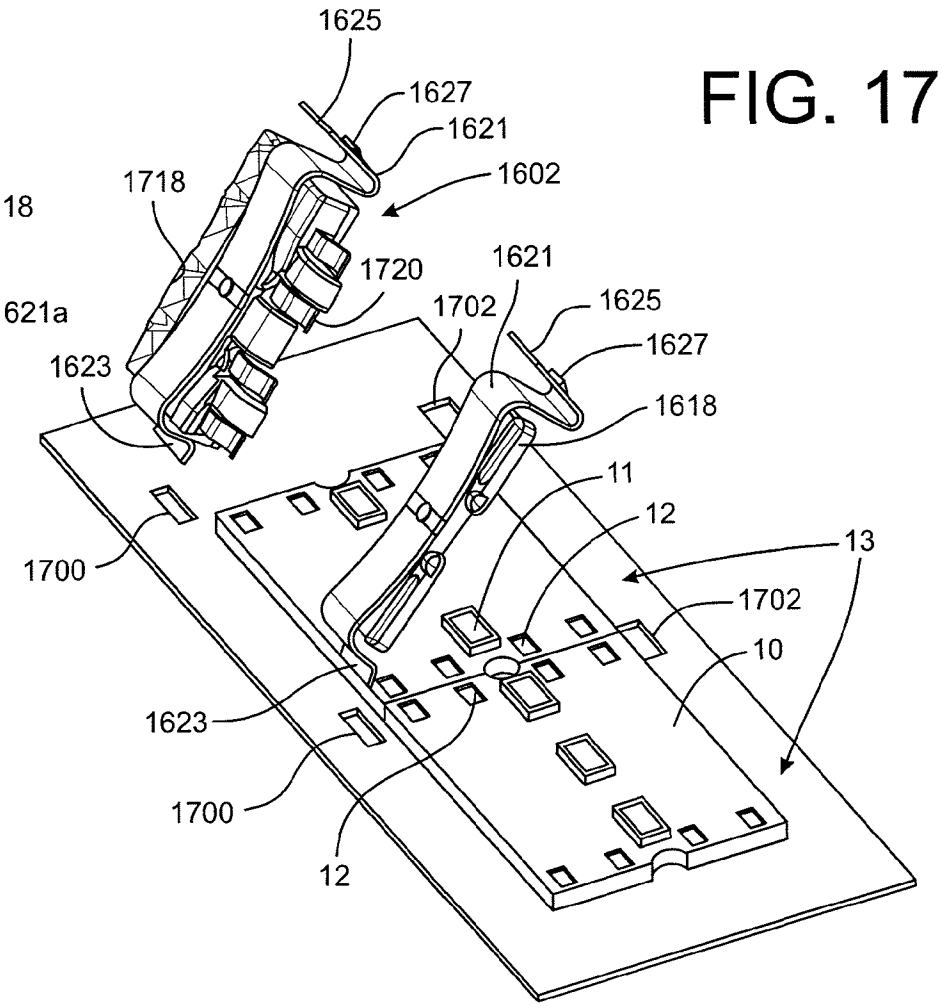
FIG. 17 is a top perspective view showing an example method of mounting the example bridge connector of FIG. 16, and an example method of mounting an example end connector of the present disclosure.
Figure 16:
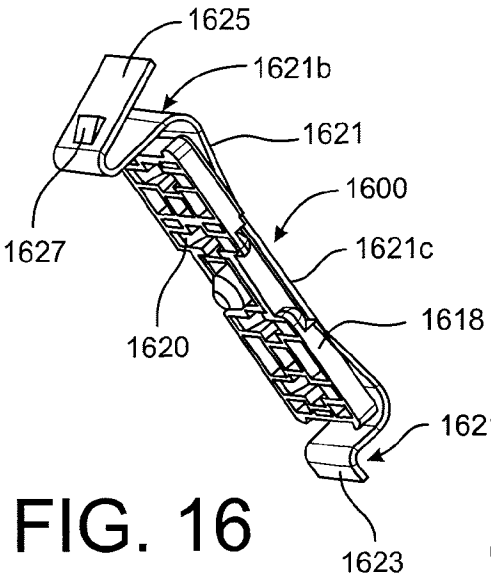
FIG. 16 is a bottom, front perspective view of another example bridge connector of the present disclosure.
Figure 18:
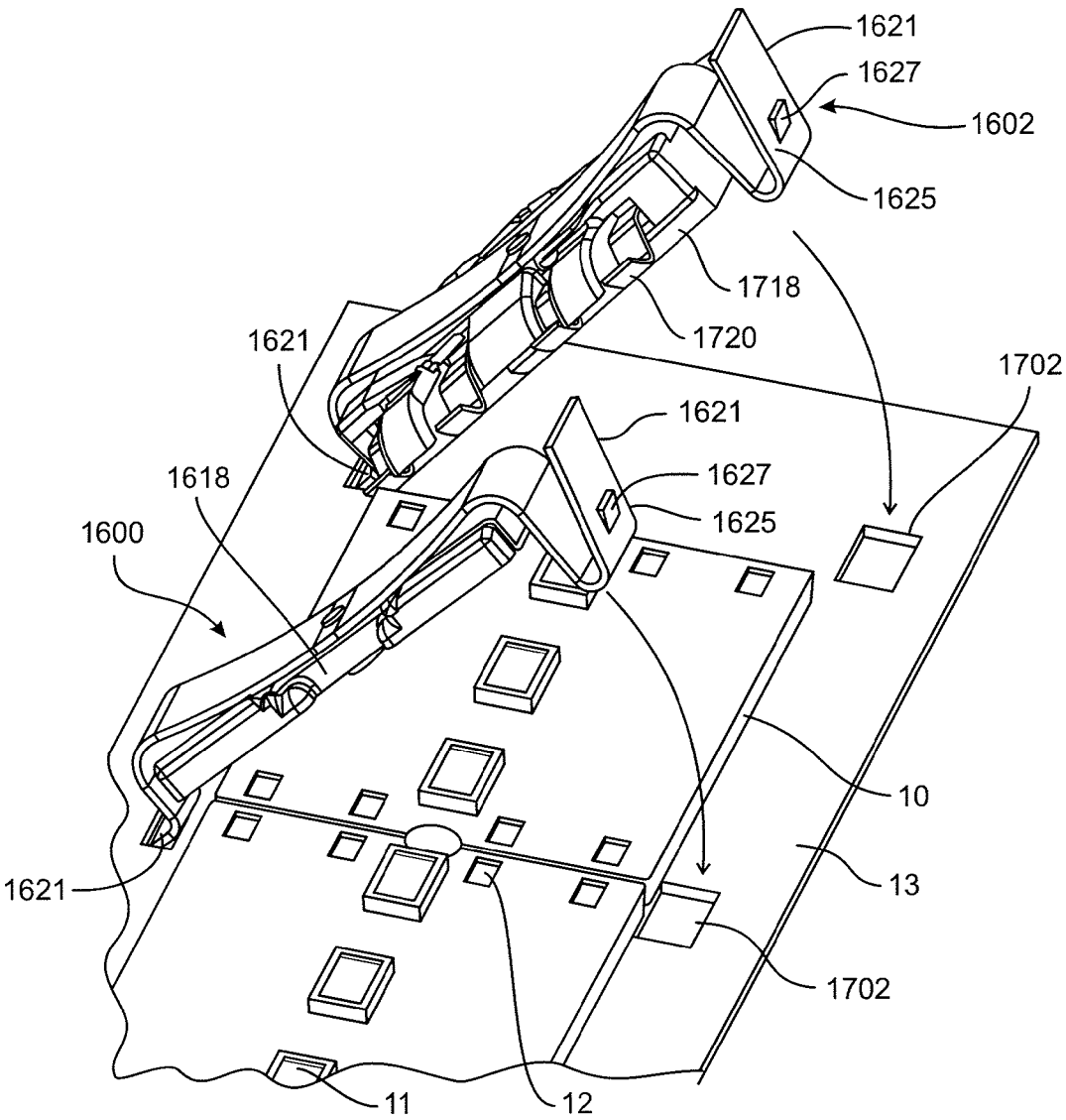
FIG. 18 is another illustration of the example method of mounting the example bridge connector and the example end connector of FIG. 17.
Figure 19:
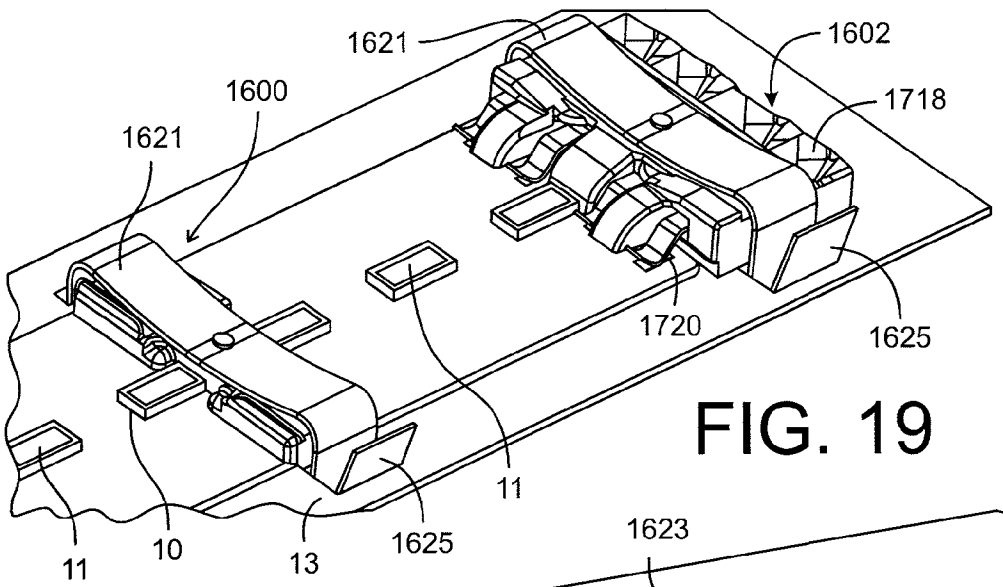
FIG. 19 is an illustration showing the example bridge connector and the example end connector of FIGS. 17 and 18 after completion of the installation process.
Figure 20:
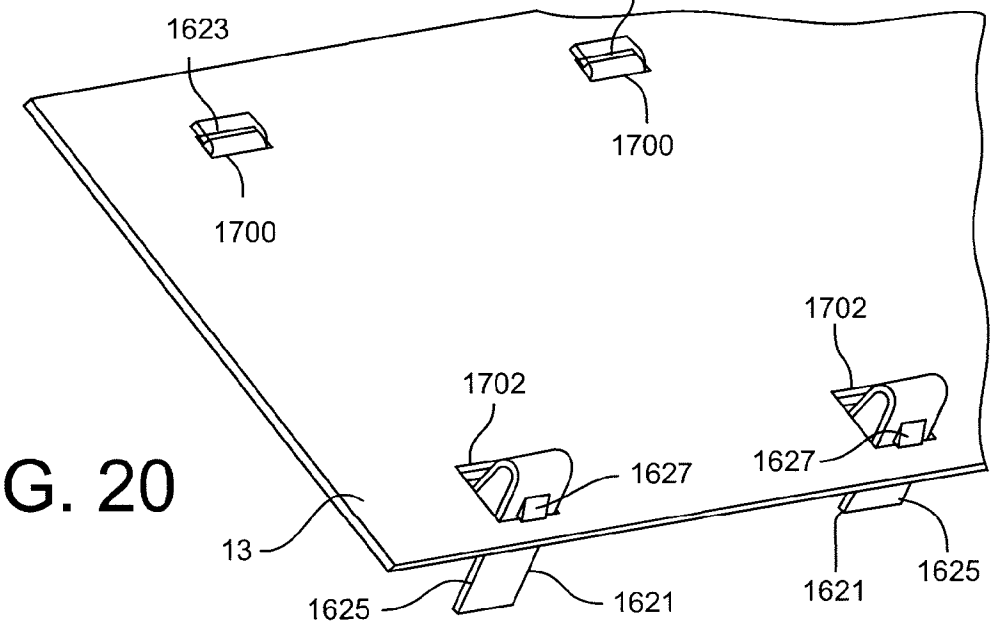
FIG. 20 is similar to the illustration of FIG. 19, showing the reverse of the mounting structure.
Figure 26:
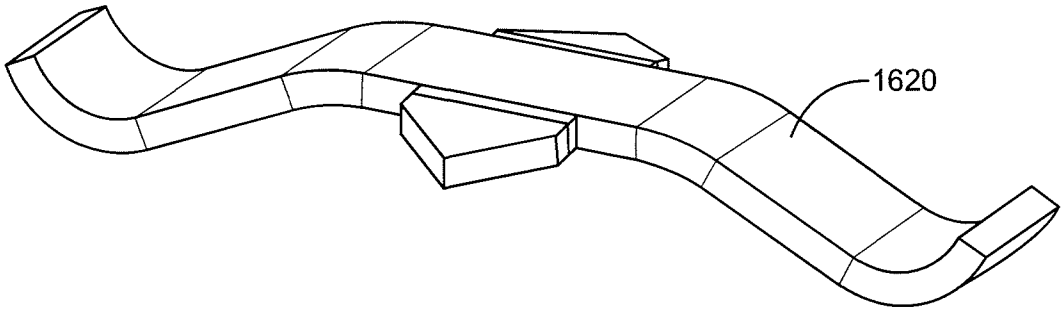
FIG. 26 is a perspective view of an example terminal for use in the example bridge connectors of FIGS. 16 and 22.

In yet another example, for providing an electrical connection to and between a first and second PCB 10 as illustrated in FIGS. 16-21, a bridge connector 1600 and an end connector 1602 are illustrated. The example bridge connector 1600 includes a housing 1618 formed using an electrically insulating material, such as plastic. The housing 1618 carries one or more connecting terminals 1620 (see FIG. 26), such as, for example, a resilient spring terminal. In this example, opposite ends of the connecting terminals 1620 are arranged to engage the contact pads 12 provided on the top side of two PCBs 10 as shown in FIG. 17. The example housing 1618 is releasably mountable to the mounting structure 13 supporting the PCBs 10 by a resilient holding element 1621. In this example, the resilient holding element 1621 includes a first end 1621*a* defining a pivoting flange 1623 and a second end 1621*b* defining a spring clip 1625.

Figure 27:
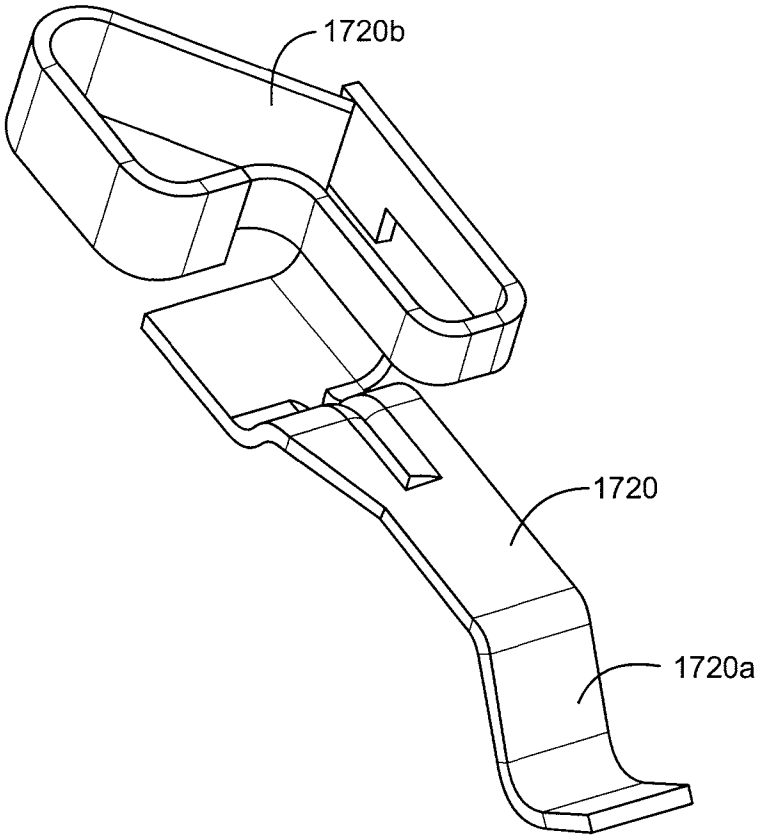
FIG. 27 is a perspective view of an example push-in type terminal for use in the example end connectors of FIGS. 17 and 23.

The example end connector 1602, meanwhile, similarly includes a housing 1718 formed using an electrically insulating material such as, for example, plastic or the like. The example housing 1718, however, carries one of more push-in type connector terminals 1720 (see FIG. 27). In this example, a first end 1720*a* is arranged to engage the contact pads 12 provide on the top side of one of the PCBs 10 as shown in FIG. 17, while a second end 1720*b* is arranged to engage and preferably retain an external conductor, such as a wire therein. The housing 1718 may be, as in the illustrated example, similarly sized as the housing of the bridge connector 1600 such that the same resilient holding element 1621 may be advantageously utilized in both instances to mount the connectors 1600, 1602 to the mounting structure 13.

Figure 21:
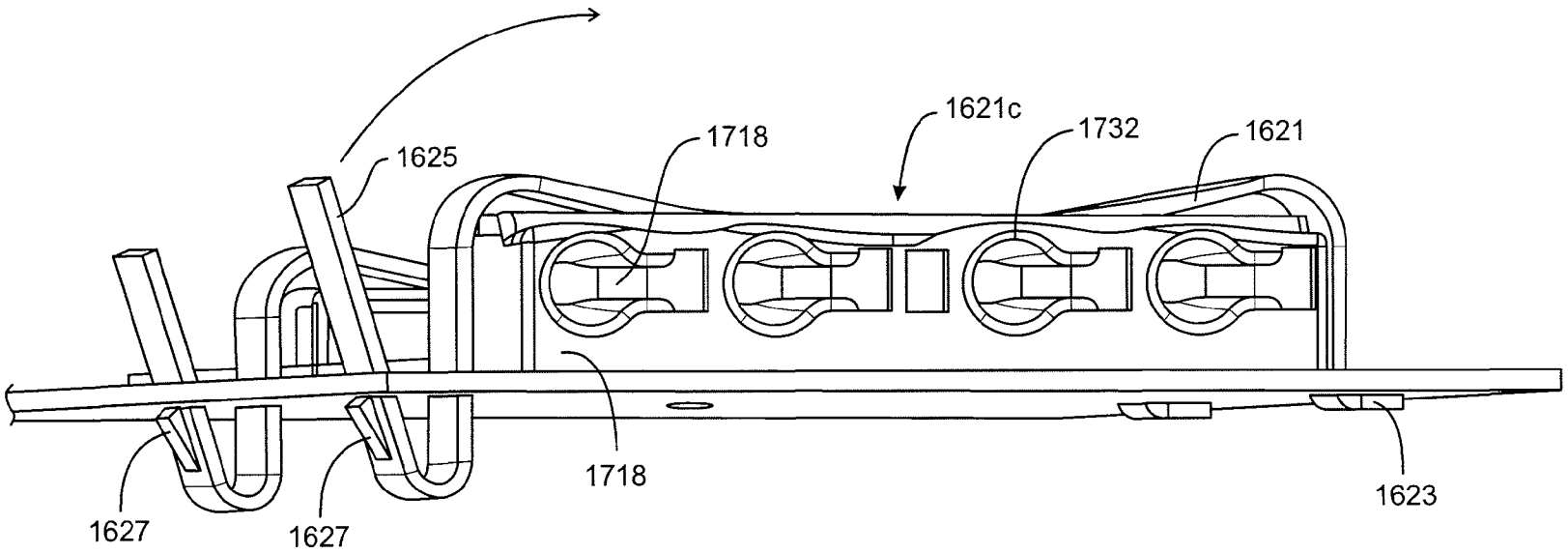
FIG. 21 is an illustration showing an example method of removing the example end connector of FIG. 17.
Figures 22, 23:
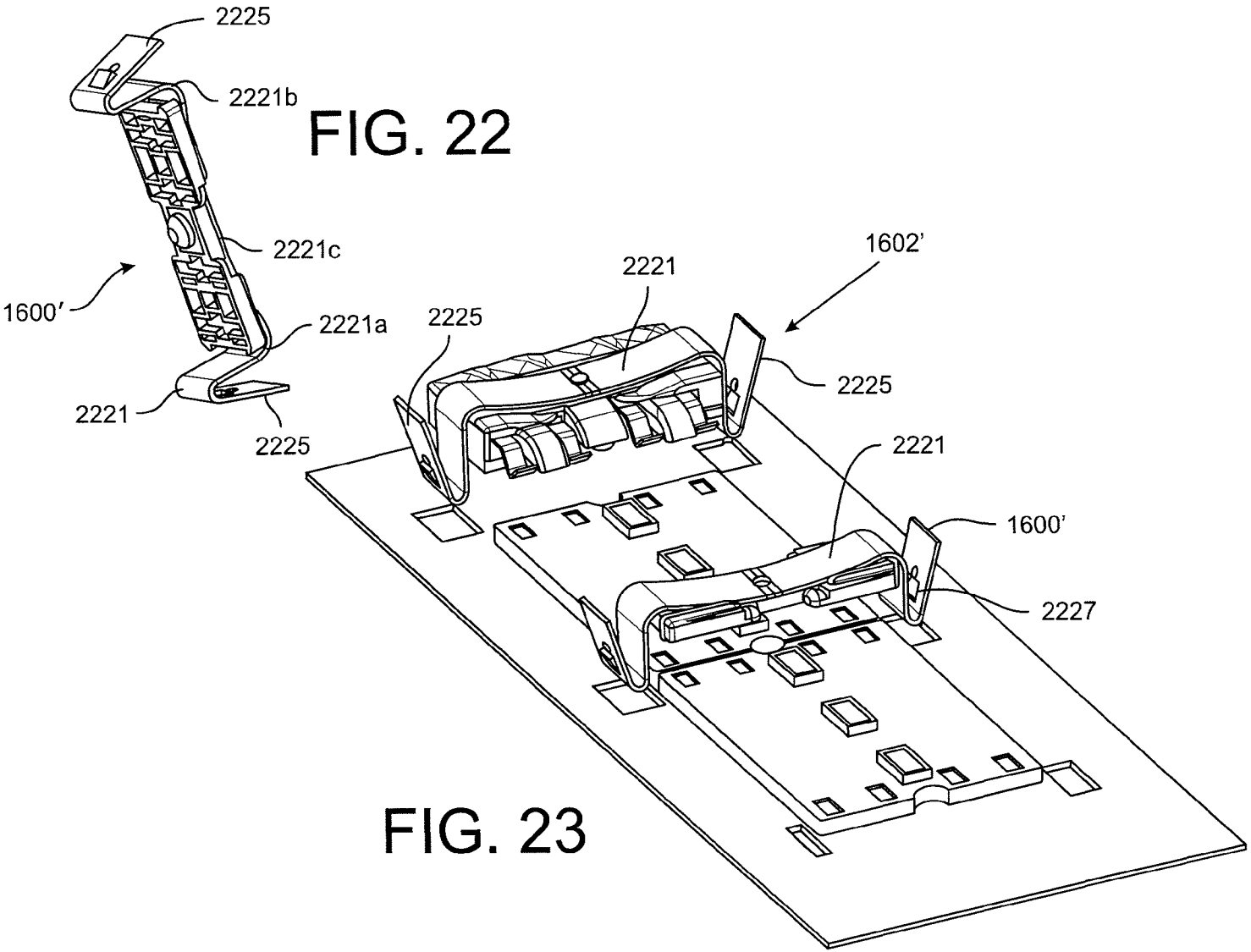
FIG. 22 is a bottom, front perspective view of another example bridge connector of the present disclosure.
FIG. 23 is a top perspective view showing an example method of mounting the example bridge connector of FIG. 22, and an example method of mounting another example end connector of the present disclosure.
Figure 24:
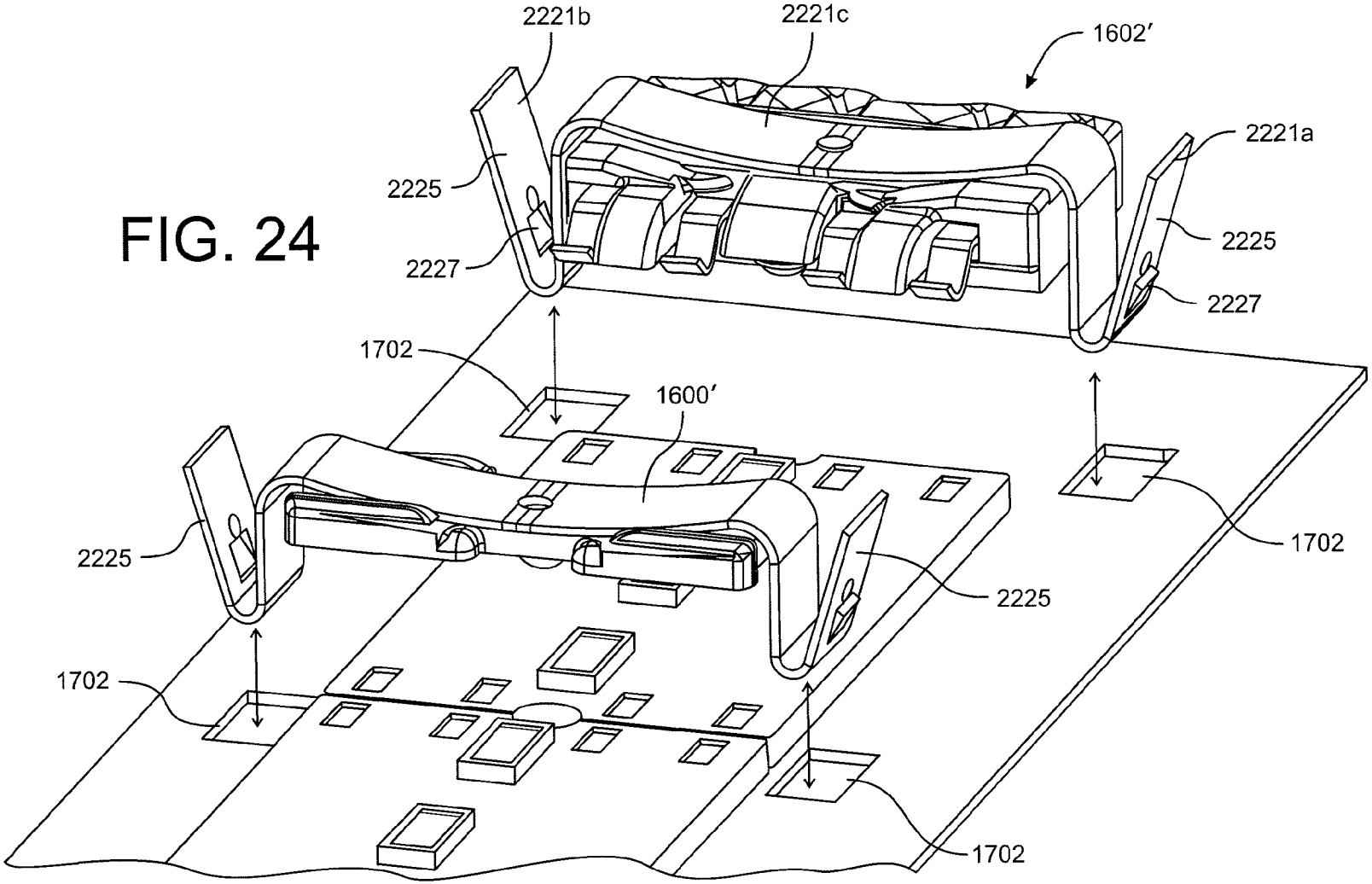
FIG. 24 is another illustration of the example method of mounting the example bridge connector and the example end connector of FIG. 23.
Figure 25:
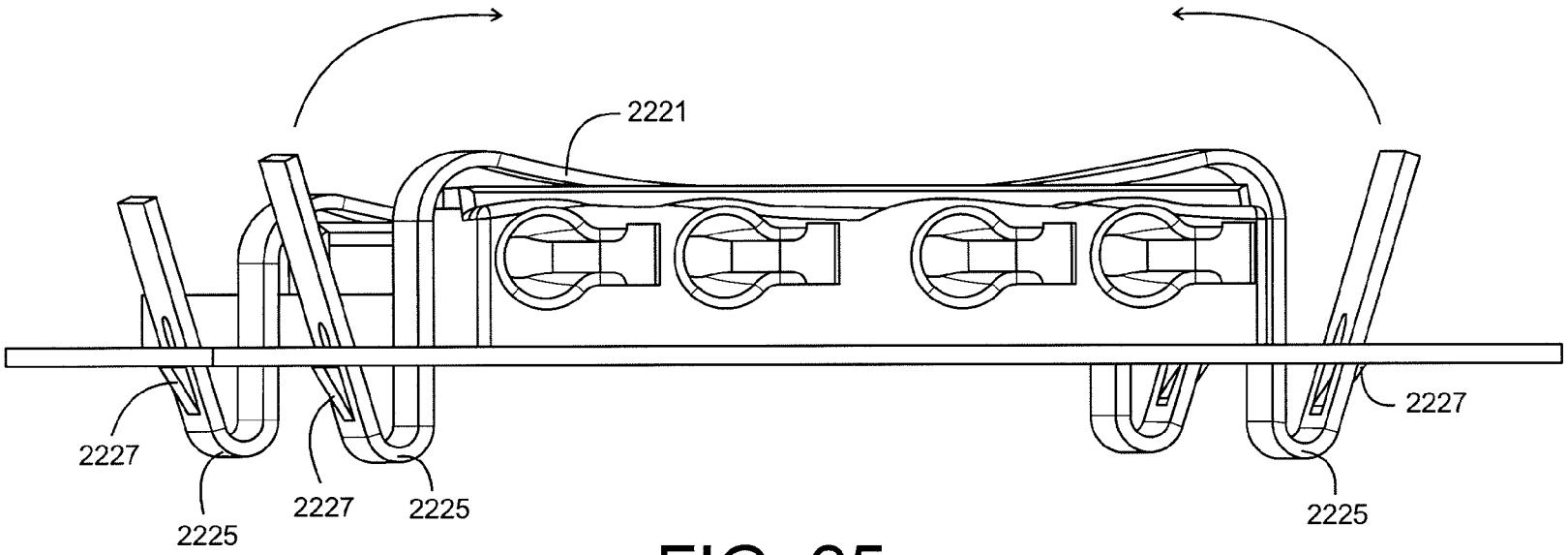
FIG. 25 is an illustration showing an example method of removing the example end connector of FIG. 23.

The example connecting terminals 1620, 1720 each have elasticity to facilitate engagement with the contact pads 12 of the PCBs 10. More particularly, both ends of the contacting terminals 1620 are exposed inside and/or outside of the housing 1618 and are arranged over an open side, a hole, a slot, a recess, opening, and/or the like formed in the housing 1618 so that the end of the connecting terminal 1620 is positionable generally above and in contact with the PCBs 10 and more specifically, with the contact pads 12. Meanwhile, the first end 1720*a* of the connecting terminal 1720 includes a flexible push-in type connector region to allow insertion and retention of an electrical conductor, such as for example, a wire, in the housing 1718. As best illustrated in FIG.21, the housing 1718 defines wire guide apertures 1732 to permit insertion of the electrical conductors in to the housing 1718. The second end 1720*b* of the contacting terminals 1720 are exposed inside and/or outside of the housing 1718 and arranged over an open side, a hole, a slot, a recess, opening, and/or the like formed in the housing 1718 so that the end of the connecting terminal 1720 is positionable generally above and in contact with the PCBs 10 and more specifically, with the contact pads 12.

As illustrated in FIG. 17, during installation of the bridge connector 1600 and the end connector 1602, the pivoting flange 1623 is first placed in an aperture 1700 defined in at least one of the mounting structure 13 or the PCB 10. Once pivoting flange 1623 is securely located in the aperture 1700, the entire connector 1600 is free to rotate and/or otherwise pivot, slide, etc., such that the spring clip 1625 similarly engages an aperture 1702 defined in the mounting structure on an opposite side of the PCB 10. In this example, the spring clip 1625 includes a tab 1627 adapted to engage the underside of the mounting structure 13 and to thus retain the spring clip 1625 within the aperture 1702. In this example, the apertures 1700, 1702 are sized to accept the pivoting flange 1623 and spring clip 1625, respectively. It will be understood by one of ordinary skill in the art that the holding element 1621 may be any suitable fastener including, for example, a screw, rivet, snap-fit tab, pressure tab, resilient and/or non-resilient fastener, etc., separately and/or integrally formed with the housing, while the aperture may be any suitable aperture including a channel, slot, opening, hole, lip, flange, etc. Additionally, in this illustration, the resilient holding element 1621 includes a biasing shape that includes a bowed portion 1621*c* that when the connector 1600 is installed against the PCB, the bowed portion tends to bias the terminal 1620 into direct electrical contact with the contact pads 12.

As will be appreciated, to remove the connectors 1600, 1602 from the mounting structure 13, the spring clip 1625 may be moved to release the tab 1627 from engagement with the underside of the mounting structure 13 and thus allow for the connector 1600, 1602 to be pivoted away from the aperture 1702 and thus be freely removed from the surface 13.

Turning now to FIGS. 22-25, there is illustrated two alternative examples of the bridge connector 1600' and the end connector 1602'. In this example, each of the connectors 1600, 1602 includes a resilient holding element 2221 similar to the resilient holding element 1621. In this example, however, the resilient holding element 2221 includes a first end 2221 a and a second end 2221*b*, each defining a spring clip 2225.

During installation of the bridge connector 1600' and the end connector 1602', the entire connector 1600' and 1602' may be rotated, pivoted, slid, pushed, etc., such that each of the spring clips 2225 engage the apertures 1702 defined in the mounting structure on opposite sides of the PCB 10. More specifically, as with the previously described holding element, 1621, each of the spring clips 2225 includes a tab 2227 adapted to engage the underside of the mounting structure 13 and thus retain the spring clips 2225 within each of the apertures 1702. Still further, As with the previously described example, the example resilient holding element 2221 includes a biasing shape that includes a bowed portion 2221*c* that when the connectors 1600', 1602' are installed against the PCB 10, the bowed portion tends to bias the terminals 1620, 1720 into direct electrical contact with the contact pads 12. Of course, it will be understood by one of ordinary skill in the art that the biasing may be any suitable shape, clamp, arrangement, etc. to ensure contact between the connectors 1600, 1602 and the contact pads 12.

As will be appreciated, to remove the connector 1600', 1602' from the mounting structure 13, either and/or both of the spring clips 2225 may be moved to release one or both of the tabs 2227 from engagement with the underside of the mounting structure 13 and thus allow for the connector 1600', 1602' to be lifted away from the surface 13.

Figure 28:
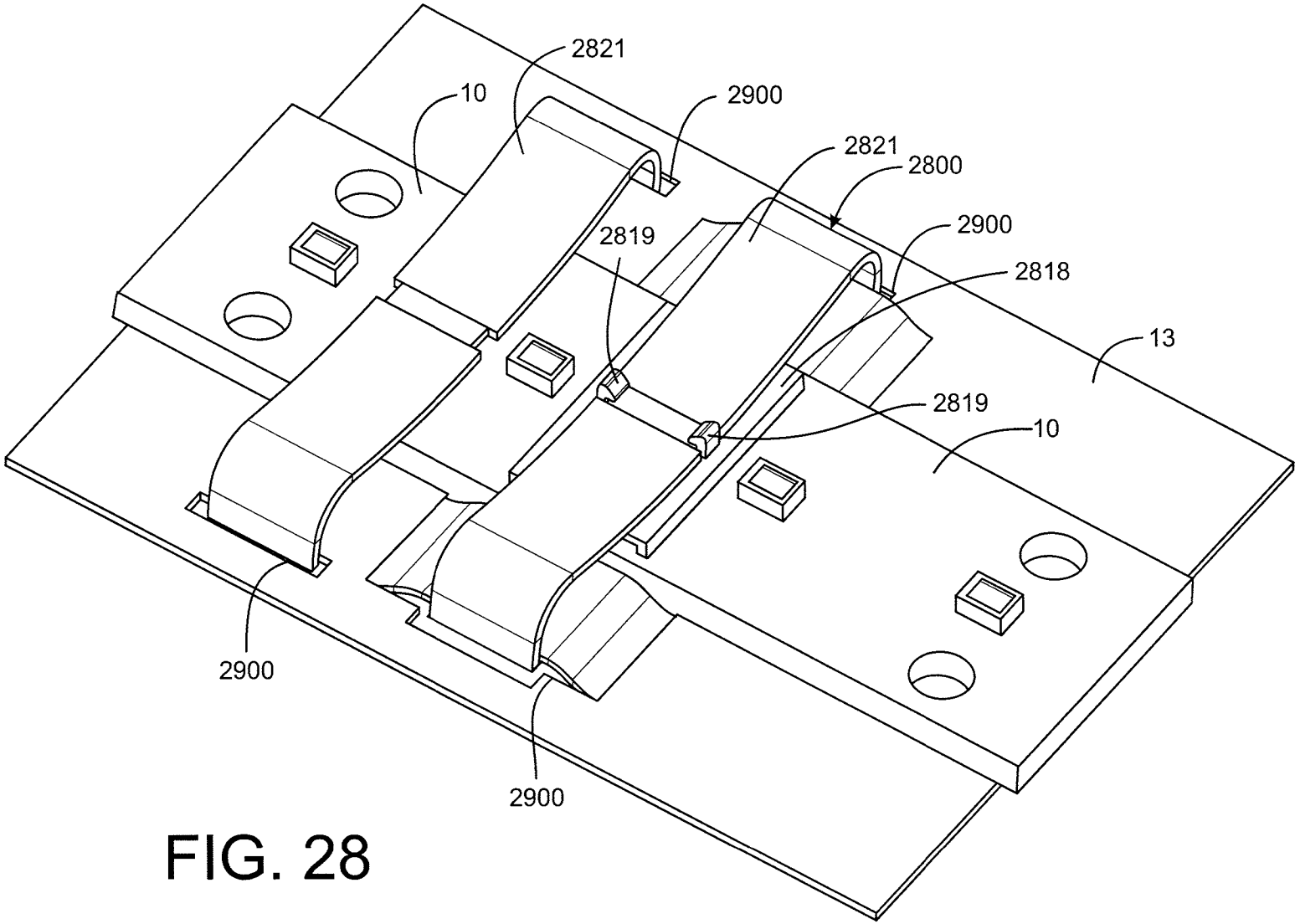
FIG. 28 is a perspective view illustrating two additional example bridge connectors of the present disclosure.
Figure 29C:
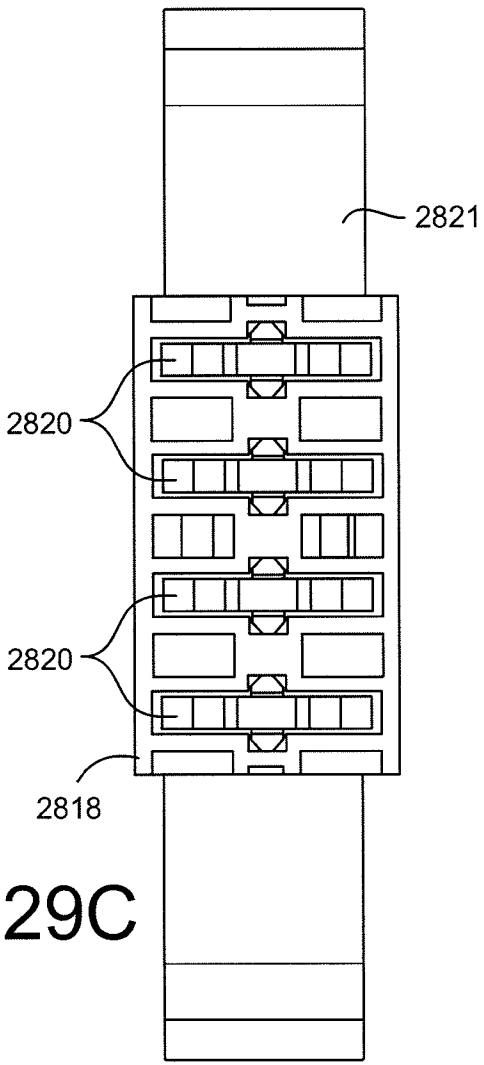
FIGS. 29A-29C together illustrate one of the example bridge connectors of FIG. 28.
Figure 29A:
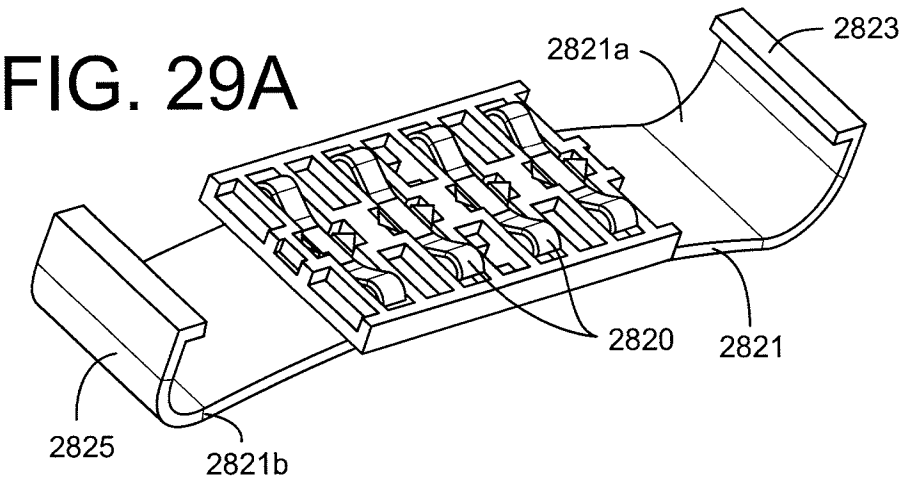
Figure 29B:
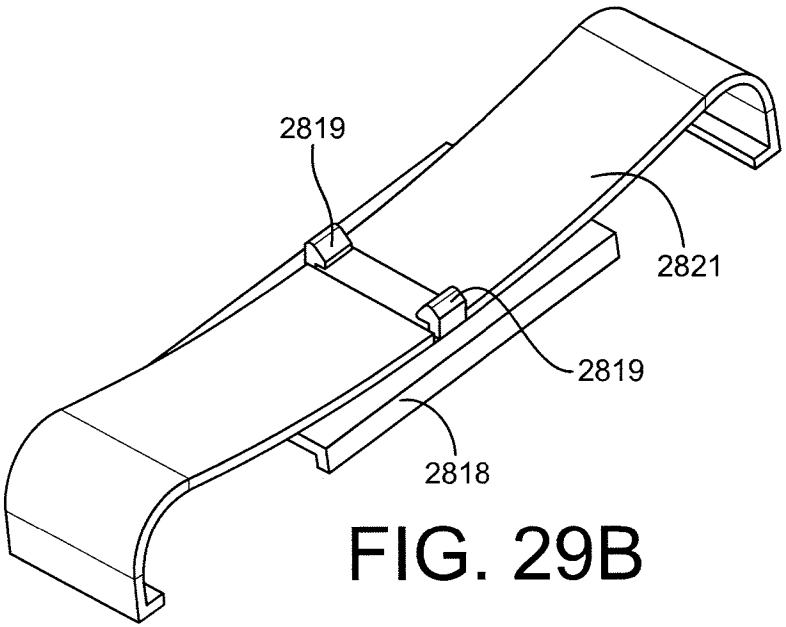

Referring now to FIGS. 28 and 29A-29C, there is illustrated yet another example bridge connector 2800 for providing an electrical connection to and/or between a first and second PCB 10. In this instance, the example bridge connector 2800 includes a housing 2818 formed using an electrically insulating material, such as plastic. The housing 2818 carries one or more connecting terminals 2820, which in this example are the same as terminals 1620. As such, in this example, opposite ends of the connecting terminals 2820 are arranged to engage the contact pads 12 provided on the top side of the two PCBs 10 as shown in FIG. 28. The example housing 2818 is releasably mountable to the mounting structure 13 supporting the PCBs 10 by a resilient holding element 2821, which may be operably connected to the housing 2818 by any suitable means, including, for instance in a clamping fit such as through the use of tabs 2819.

In this example, the resilient holding element 2821 includes a first end 2821*a* defining a flange 2823 and a second end 2821*b* defining a second flange 2825. Thus, during installation of the bridge connector 2800, the connector 2800 may be placed and moved towards the mounting structure 13 such that the flanges 2823, 2825 flex outward and engage in slots, lips, channels, apertures, etc. 2900 formed in the mounting structure 13. As illustrated, the resilient holding element 2821 includes a biasing shape that includes a bowed portion 2821*c* that when the connector 2800 is installed against the PCB 10, the bowed portion tends to bias the terminal 2820 into direct electrical contact with the contact pads 12. Alternatively, the holding element 2800 may be utilized separately from the housing 2818 to hold and/or otherwise support the PCB 10 directly as shown in FIG. 28. As will be appreciated, to remove the connector 2818 from the mounting structure 13, the flanges 2823, 2825 may be moved outward by force, camming, tool, etc. to release the flanges 2823, 2825 from engagement with the slots 2900 formed in the mounting structure 13.

Figure 32:
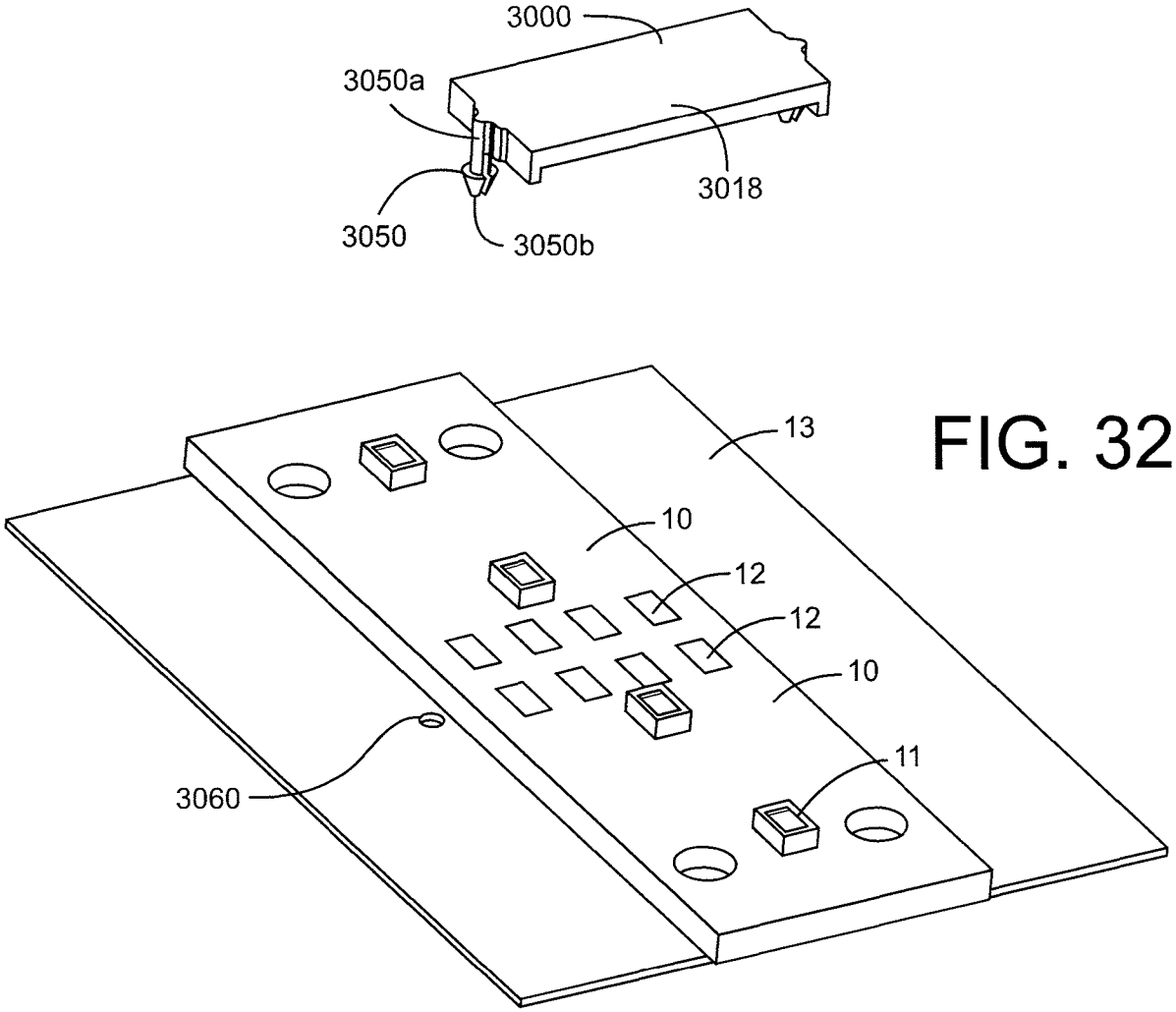
FIG. 32 illustrates an example method of mounting the example bridge connector of FIG. 31.

In yet another example illustrated in FIGS. 30A-32, for providing an electrical connection to and/or between a first and second PCB 10, a bridge connector 3000 is illustrated. The example bridge connector 3000 includes a housing 3018 formed using an electrically insulating material, such as plastic. In this instance, the example housing 3000 carries one or more connecting terminals 3020, which in this example are the same as terminals 1620. As such, in this example, opposite ends of the connecting terminals 3020 are arranged to engage the contact pads 12 provided on the top side of the two PCBs 10 as shown in FIG. 32.

In this instance, however, the example housing 3018 is releasably mountable to the mounting structure 13 supporting the PCBs 10, or to the PCBs 10 directly by a resilient holding element 3050, which is a resilient tab for releasably coupling to an aperture formed in the PCB 10 or the mounting structure 13.

Figure 30A:
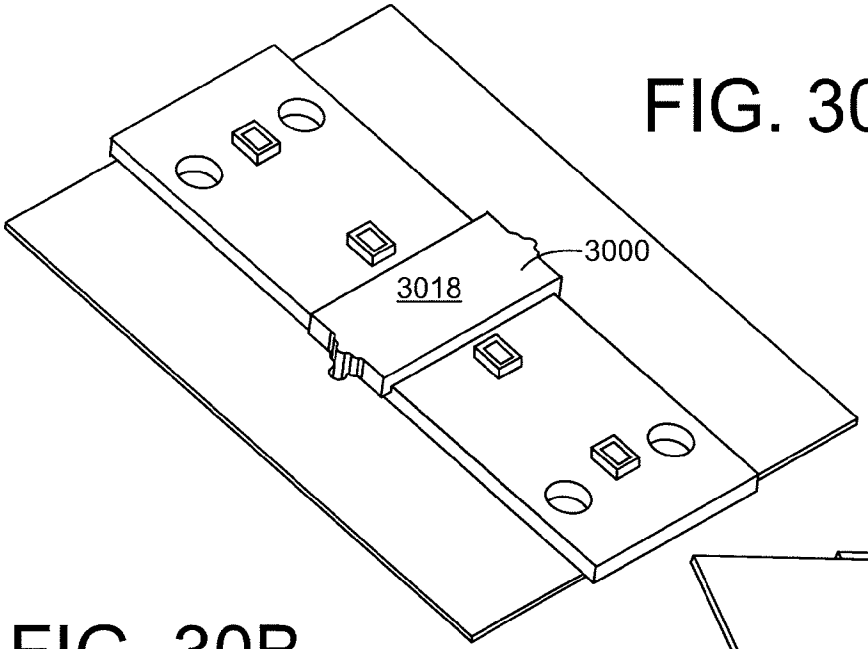
FIGS. 30A-30C together illustrate another example bridge connector of the present disclosure.
Figure 30C:
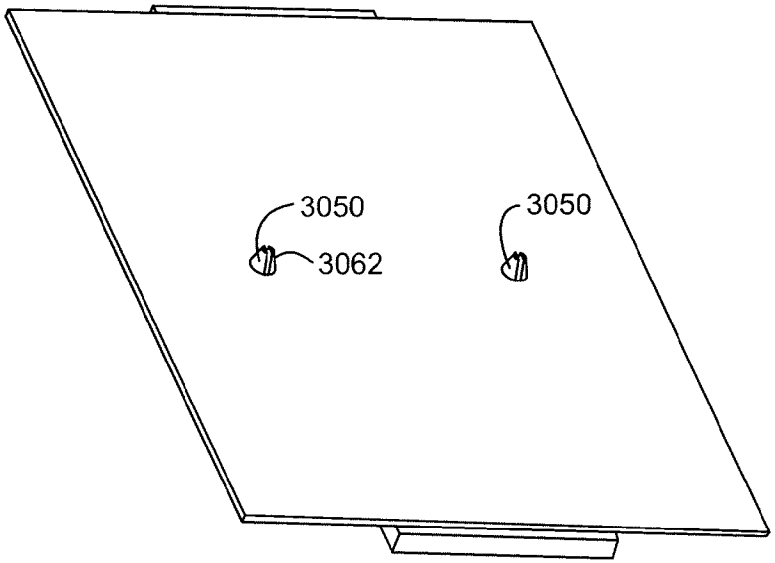
Figure 30B:
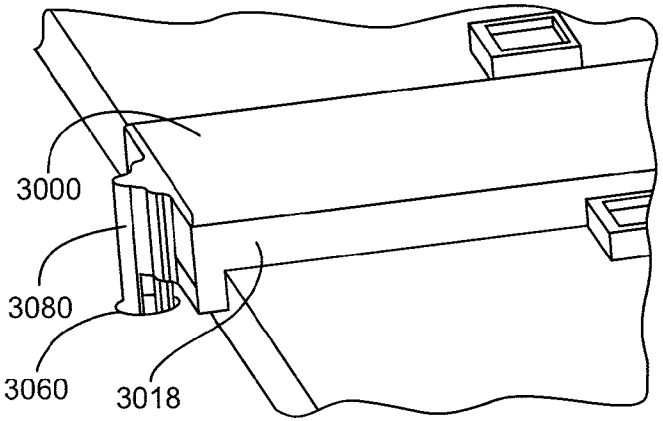
Figure 31:
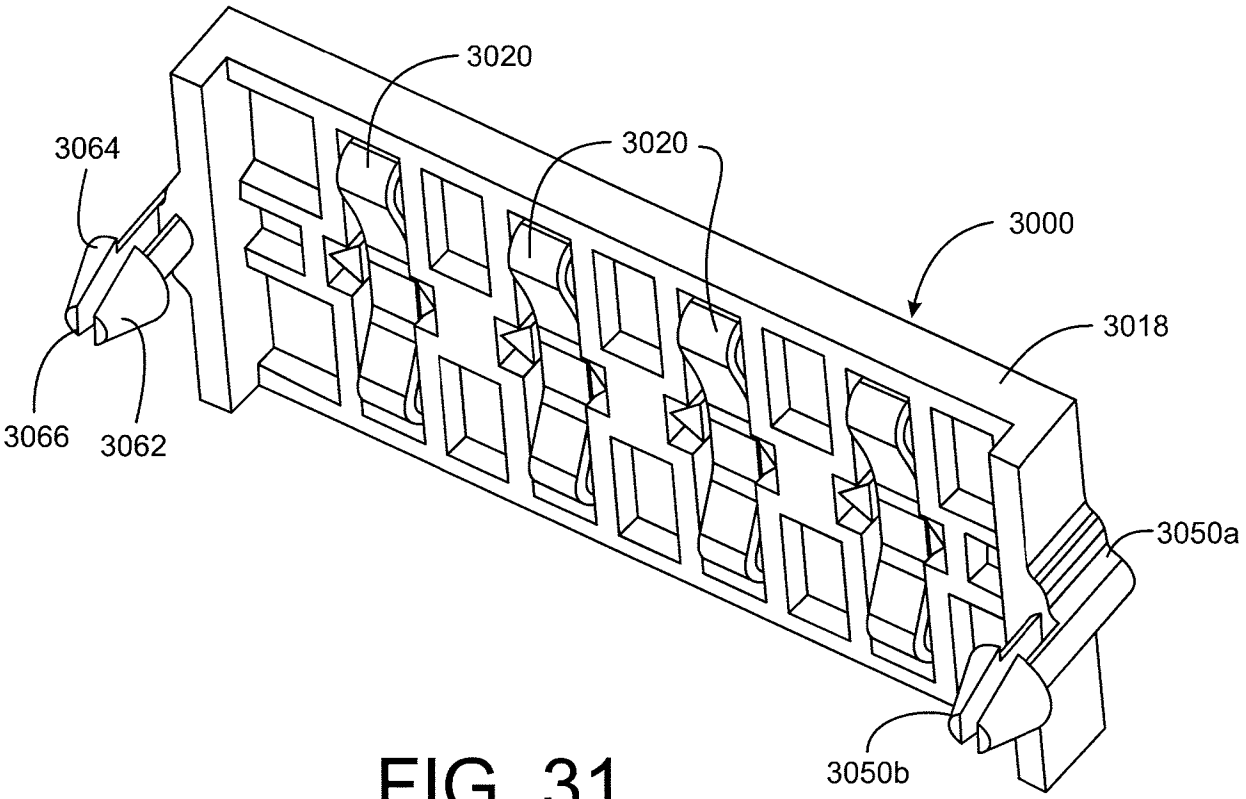
FIG. 31 is a bottom perspective view of the example bridge connector of FIGS. 30A-30C.

Specifically, in this example, the resilient holding element 3050 includes a first end 3050*a* integrally formed with the housing 3050 and a second end 3050*b* defined a cammed conical shaped tab 3062 having a lip 3064 arranged to engage the underside of the mounting structure 13 (see FIG. 30C). In this example, the tab 3062 includes a channel 3066 to allow the tab 3062 to resiliently deform and/or otherwise move so as to allow the housing 3018 to be connected to and/or removed from the mounting structure 13. It will be appreciate by one of ordinary skill in the art that the size, shape, and/or arrangement of the tab 3062 may be any suitable design as desired. For example, the tab 3062 need not be conical shape, but may preferably be so to assist in alignment during installation.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A connector for electrically connecting a first printed circuit board (PCB) with a second PCB, comprising:

a housing having a first portion and a second portion that is coupled to the first portion and moveable relative to the first portion between a first position and a second position; and at least one connecting terminal having opposed ends wherein the at least one connecting terminal is arranged between the first portion and the second portion so as to be moveable with the second portion relative to the first portion whereby, when the second portion is moved to the first position with the first portion mounted proximate to an edge provided by the first PCB and the second PCB, the opposed ends are positioned within the housing between the first portion and the second portion and, when the second portion is moved to the second position with the first portion mounted proximate to the edge provided by the first PCB and the second PCB, the opposed ends are positioned to electrically engage an electrical contact pad formed on a respective surface of each of the first PCB and the second PCB.

2. The connector as recited in claim 1, wherein the first portion and the second portion are integrally formed.

3. The connector as recited in claim 1, wherein the second portion is releasably attachable to the first portion.

4. The connector as recited in claim 3, wherein the second portion is slidably coupled to the first portion.

5. The connector as recited in claim 1, wherein the connecting terminal is adapted to accept a conductor and to thereby electrically couple the conductor to the first and second PCBs.

6. The connector as recited in claim 5, wherein the connecting terminal comprises a first connecting terminal and a second connecting terminal arranged to electrically engage the conductor when inserted therebetween.

7. The connector as recited in claim 5, wherein the connecting terminal is arranged to provide a push-in type connector for the conductor.

8. The connector as recited in claim 1, wherein opposed sides of the first portion are each provided with a fastener accepting feature for accepting a fastener used to secure the first portion proximate to the edge provided by the first PCB and the second PCB.

9. The connector as recited in claim 1, wherein the fastener accepting features comprises a slot for slidably receiving the fastener.

10. The connector as recited in claim 3, wherein the first portion has a locking element which is moveable relative to the first portion for securing the first portion in a position proximate to the first PCB and the second PCB.

11. The connector as recited in claim 1, wherein the housing has a keyed feature adapted to mate with a correspondingly keyed feature provided to at least one of the first PCB and the second PCB.

12. A connector for electrically connecting a PCB with a conductor, comprising:

housing having a first portion and a second portion that is coupled to the first portion and moveable relative to the first portion between a first position and a second position; and at least one connecting terminal having an end wherein the at least one connecting terminal is arranged between the first portion and the second portion so as to be moveable with the second portion relative to the first portion whereby, when the second portion is moved to the first position with the first portion mounted proximate to an edge provided by the PCB, the end is positioned within the housing between the first portion and the second portion and, when the second portion is moved to the second position with the first portion mounted proximate to the edge provided by the PCB, the end is positioned to electrically engage a contact pad formed on the PCB and wherein a portion of the connecting terminal is further arranged to engage a conductor.

13. The connector as recited in claim 12, wherein the second portion is slidably coupled to the first portion.

14. The connector as recited in claim 12, wherein the second portion is releasably coupled to the first portion.

15. The connector as recited in claim 12, wherein the the first portion is adapted to be attached to a mounting structure upon which the PCB is mounted using one or more fasteners.

16. The connector as recited in claim 12, wherein the housing has a keyed feature adapted to mate with a correspondingly keyed feature provided to the PCB.

17. The connector as recited in claim 12, wherein the first portion has a locking element which is moveable relative to the first portion for securing the first portion in a position proximate to the first PCB and the second PCB.

18. The connector as recited in claim 12, wherein the second portion has an opening arranged to be in communication with the connecting terminal and sized to receive the conductor.

19. The connector as recited in claim 12, wherein the connecting terminal comprises a first connecting terminal and a second connecting terminal arranged to electrically engage the conductor when inserted therebetween.

20. The connector as recited in claim 12, wherein the connecting terminal is a push-in style connecting terminal.

21. A connector for electrically connecting a first printed circuit board (PCB) with a second PCB, comprising:

a housing having a first side and an opposed second side;

at least one connecting terminal carried by the second side of the housing having opposed ends each of which are arranged to electrically engage a contact pad formed on a respective surface of each the first PCB and the second PCB; and a resilient holding element, disposed upon the first side of the housing, having at least one engagement feature that is cooperable with at least one of a mounting structure supporting the first PCB and the second PCB or at least one of the first PCB or the second PCB to retain the housing proximate to the first PCB and the second PCB with the opposed ends of the connecting terminal in electrical engagement with the contact pad formed on the respective surface of each of the first PCB and the second PCB.

22. The connector as recited in claim 21, wherein the at least one engagement feature is adapted to be directly mountable to the mounting structure.

23. The connector as recited in claim 21, wherein the at least one engagement feature is adapted to be attached to the mounting structure using one or more apertures defined in the mounting structure.

24. The connector as recited in claim 21, wherein the connecting terminal is further adapted to accept a conductor and to thereby electrically couple the conductor to the contact pad formed on the respective surface of each of the first PCB and the second PCB.

25. The connector as recited in claim 24, wherein the connecting terminal is arranged to provide a push-in type connector for the conductor.

26. The connector as recited in claim 21, wherein the at least one engagement feature comprises a spring clip.

27. The connector as recited in claim 21, wherein the housing has a keyed feature adapted to mate with a correspondingly keyed feature provided to at least one of the first PCB or the second PCB.

28. The connector as recited in claim 21, wherein the resilient holding element is releasably coupled to the first side of the housing.

29. The connector as recited in claim 21, wherein the resilient holding element is attached to the first side of the housing.

30. The connector as recited in claim 21, wherein the housing is removably mountable proximate to the first PCB and the second PCB.

31. The connector as recited in claim 24, wherein the housing has an opening in communication with the connecting terminal that is sized to accept the conductor.

32. A connector for electrically connecting a PCB with a conductor, comprising:

a housing having a first side and a second side;

at least one connecting terminal carried by the second side of the housing having a portion which is arranged to electrically engage a contact pad formed on the PCB and a portion which is arranged to engage a conductor; and a resilient holding element, disposed upon the first side of the housing, having at least one feature that is cooperable with at least one of a mounting structure supporting the PCB or the PCB to retain the housing proximate to the PCB with the connecting terminal in electrical engagement with the contact pad.

33. The connector as recited in claim 32, wherein the at least one engagement feature is adapted to be directly mountable to the mounting structure.

34. The connector as recited in claim 32, wherein the at least one engagement feature is adapted to be attached to the mounting structure using one or more apertures defined in the mounting structure.

35. The connector as recited in claim 32, wherein the connecting terminal is arranged to provide a push-in type connector for the conductor.

36. The connector as recited in claim 32, wherein the housing has a keyed feature adapted to mate with a correspondingly keyed feature provided to the PCB.

37. The connector as recited in claim 32, wherein the resilient holding element is releasably coupled to the first side of the housing.

38. The connector as recited in claim 32, wherein the at least one engagement feature comprises a spring clip.

39. The connector as recited in claim 32, wherein the housing is removably mountable proximate the PCB.

40. A connector as recited in claim 32, wherein the housing has an opening in communication with the connecting terminal that is sized to accept the conductor.

* * * * *